US011837111B1

(12) United States Patent
Borell

(10) Patent No.: US 11,837,111 B1
(45) Date of Patent: Dec. 5, 2023

(54) ILLUMINATED SIGN ASSEMBLY

(71) Applicant: Steel Art Company, Norwood, MA (US)

(72) Inventor: John Borell, Norwood, MA (US)

(73) Assignee: Steel Art Company, Norwood, MA (US)

( * ) Notice: Subject to any disclaimer, the term of this patent is extended or adjusted under 35 U.S.C. 154(b) by 732 days.

(21) Appl. No.: 15/931,854

(22) Filed: May 14, 2020

Related U.S. Application Data

(60) Provisional application No. 62/961,631, filed on Jan. 15, 2020, provisional application No. 62/913,358, filed on Oct. 10, 2019, provisional application No. 62/848,133, filed on May 15, 2019.

(51) Int. Cl.

| | |
|---|---|
| ***G09F 13/04*** | (2006.01) |
| ***G09F 13/06*** | (2006.01) |
| ***G09F 13/10*** | (2006.01) |
| *G09F 13/22* | (2006.01) |

(52) U.S. Cl.
CPC ..... *G09F 13/0413* (2013.01); *G09F 13/0404* (2013.01); *G09F 13/06* (2013.01); *G09F 13/10* (2013.01); *G09F 13/0418* (2021.05); *G09F 2013/222* (2013.01)

(58) Field of Classification Search
CPC ..... G09F 13/00; G09F 13/04; G09F 13/0413; G09F 13/0404; G09F 13/0418; G09F 13/049; G09F 13/08; G09F 13/10; G09F 2013/222; Y10S 362/812
See application file for complete search history.

(56) References Cited

U.S. PATENT DOCUMENTS

| | | | | |
|---|---|---|---|---|
| D22,077 | S | 12/1892 | Curtis | |
| 1,122,164 | A * | 12/1914 | Schneider | G09F 13/0404 40/552 |
| 1,904,850 | A * | 4/1933 | Boyce | G09F 13/06 40/552 |
| 2,147,748 | A * | 2/1939 | Edward | G09F 13/04 40/619 |
| D313,431 | S | 1/1991 | Jaskiel et al. | |
| D345,379 | S | 3/1994 | Chan | |
| 5,604,480 | A * | 2/1997 | Lamparter | B60Q 1/50 362/478 |
| D455,788 | S | 4/2002 | Gentelia et al. | |
| D502,743 | S | 3/2005 | Draper | |
| D510,109 | S | 9/2005 | Cobb et al. | |
| 7,086,769 | B1 * | 8/2006 | Thompson | G02B 6/0001 40/550 |

(Continued)

OTHER PUBLICATIONS

Steel Art, posted at Facebook.com, posted on Apr. 16, 2019, online, available from internet: http://www.facebook.com/steelartco/photos/a.1476261042640442/2255516408048231/?type=3&theater.

(Continued)

*Primary Examiner* — Cassandra Davis
(74) *Attorney, Agent, or Firm* — Greenberg Traurig, LLP; Roman Fayerberg

(57) ABSTRACT

There is provided a sign assembly comprising: an illumination panel; a decorative panel mounted to the illumination panel and comprising informational graphics; and one or more light sources positioned such that the illumination panel is illuminated by the one or more light sources to provide a light band about the decorative panel.

22 Claims, 24 Drawing Sheets

(56) References Cited

U.S. PATENT DOCUMENTS

| | | | | |
|---|---|---|---|---|
| 7,162,821 | B2 * | 1/2007 | Venkataraman | G09F 13/04 40/552 |
| D586,859 | S | 2/2009 | King et al. | |
| D587,761 | S | 3/2009 | Grimshaw | |
| D590,890 | S | 4/2009 | King et al. | |
| D598,054 | S | 8/2009 | Grimshaw | |
| D607,942 | S | 1/2010 | Brazelton et al. | |
| D608,830 | S | 1/2010 | Taylor et al. | |
| 7,721,475 | B2 * | 5/2010 | Chiang | G09F 13/04 40/564 |
| D634,861 | S | 3/2011 | Whittier et al. | |
| D641,794 | S | 7/2011 | Yi et al. | |
| D645,908 | S | 9/2011 | Yi et al. | |
| D664,211 | S | 7/2012 | Hase et al. | |
| D708,459 | S | 7/2014 | Heirakuji et al. | |
| D721,893 | S | 2/2015 | Gorham | |
| D724,151 | S | 3/2015 | Indio da Costa et al. | |
| D729,548 | S | 5/2015 | Denby et al. | |
| D740,571 | S | 10/2015 | Gorham | |
| D745,418 | S | 12/2015 | Indio da Costa et al. | |
| 9,449,539 | B2 * | 9/2016 | Sciackitano | G09F 13/16 |
| D788,226 | S | 5/2017 | Lueken | |
| D846,028 | S | 4/2019 | Svihilik | |
| D903,764 | S | 12/2020 | Borell | |
| D903,765 | S | 12/2020 | Borell | |
| D903,766 | S | 12/2020 | Borell | |
| D903,767 | S | 12/2020 | Borell | |
| 2007/0103922 | A1 * | 5/2007 | Rissmiller | B60Q 1/50 362/540 |
| 2008/0016734 | A1 * | 1/2008 | Basha | G09F 13/04 40/552 |

OTHER PUBLICATIONS

Steel Art, posted at Facebook.com, posted on Jul. 2, 2020, online, available from internet: http://www.facebook.com/steelartco/photos/a.1476261042640442/2620583331541535/?type=3&theater.

* cited by examiner

ILLUMINATED SIGN ASSEMBLY

RELATED APPLICATIONS

This application claims the benefit of and priority to U.S. Provisional Application No. 62/848,133, filed May 15, 2019, U.S. Provisional Application No. 62/913,358, filed Oct. 10, 2019 and U.S. Provisional Application No. 62/961,631 filed Jan. 15, 2020, the disclosures of each of which are incorporated herein by reference in their entireties.

FIELD

The present disclosure relates to an illuminated signage assembly. In particular, the present disclosure relates to three-dimensional construction for an illuminated sign constructed from graphics and decorative laminates.

BACKGROUND

Generally, traditional signage is constructed from a single piece material with graphics engraved and/or printed thereon. Such signage may not be easily visible, especially in a low lighting office environment. Accordingly, there is a need for a signage assembly that readily stand out.

SUMMARY

There is a need for improvements for signage options. The present disclosure is directed toward further solutions to address this need, in addition to having other desirable characteristics. Specifically, a hybrid sign design constructed using an illumination source, an illumination panel, and a decorative panel constructed in a layered manner is provided.

In some embodiments, there is provided a sign assembly comprising: an illumination panel; a decorative panel mounted to the illumination panel and comprising informational graphics; and one or more light sources positioned such that the illumination panel is illuminated by the one or more light sources to provide a light band about the decorative panel. In some embodiments, the illumination panel is made of a transparent material or a translucent material. In some embodiments, the decorative panel includes at least one cutout comprising stencil-cut graphics so that the stencil cut graphics are illuminated by the illumination panel. In some embodiments, a light transmitting insert is disposed in the cutout of the decorative panel. In some embodiments, the decorative panel is a sheet of decorative material. In some embodiments, the decorative panel is three dimensional such that the decorative panel is coupled to the illumination panel to form an enclosure, and the one or more light sources are disposed in the enclosure. In some embodiments, the light emitting sources comprises a plurality of light emitting diodes (LEDs) positioned around an interior perimeter of the decorative panel. In some embodiments, the sign assembly further comprises a background panel mounted on the illumination panel opposite the decorative panel. In some embodiments, the background panel includes a recessed area therein sized and shaped to receive at least a portion of the illumination panel. In some embodiments, the background panel is a textured, colored acrylic. In some embodiments, the illumination panel is mounted on the background panel in a location such that a portion of the illumination panel extends beyond the perimeter of the background panel.

In some embodiments, there is provided a sign assembly comprising: an illumination panel made of a translucent material and having a first side and a second side opposing the first side; an opaque decorative panel mounted to the first surface of the illumination panel and comprising informational graphics; a background panel mounted to the second side of the illumination panel, the illumination panel being disposed within a recessed area in the background area with at least a portion of the illumination panel protruding from the recessed area; and one or more light sources positioned to illuminate the elimination panel such that the light emanating from the exposed portion of the illumination panel creates a light band about the decorative panel. In some embodiments, the background panel is a textured acrylic. In some embodiments, the illumination panel is mounted on the background panel such that the illumination panel extends beyond the perimeter of the background panel. In some embodiments, the decorative panel includes a cutout comprising stencil-cut graphics exposing at least a portion of the illumination panel so that the stencil-cut graphics are illuminated by the illumination panel. In some embodiments, a light transmitting insert is disposed in the cutout of the decorative panel. In some embodiments, the decorative panel is a sheet of decorative material. In some embodiments, the decorative panel is three dimensional such that the decorative panel and the illumination panel form an enclosure, and the one or more light sources are disposed in the enclosure.

In some embodiments, there is provide a sign assembly comprising: an illumination panel made of a translucent material and having a first side and a second side opposing the first side; an opaque decorative panel mounted to the first surface of the illumination panel and comprising informational graphics; a background panel mounted to the second side of the illumination panel such that the illumination panel extend beyond the perimeter of the background panel, the illumination panel being disposed within a recessed area in the background area with at least a portion of the illumination panel protruding from the recessed area; and one or more light sources positioned to illuminate the elimination panel such that the light emanating from the exposed portion of the illumination panel creates a light band about the decorative panel. In some embodiments, the background panel is a textured, colored acrylic.

BRIEF DESCRIPTION OF THE FIGURES

These and other characteristics of the present disclosure will be more fully understood by reference to the following detailed description in conjunction with the attached drawings, in which.

DETAILED DESCRIPTION

Figure 1A:
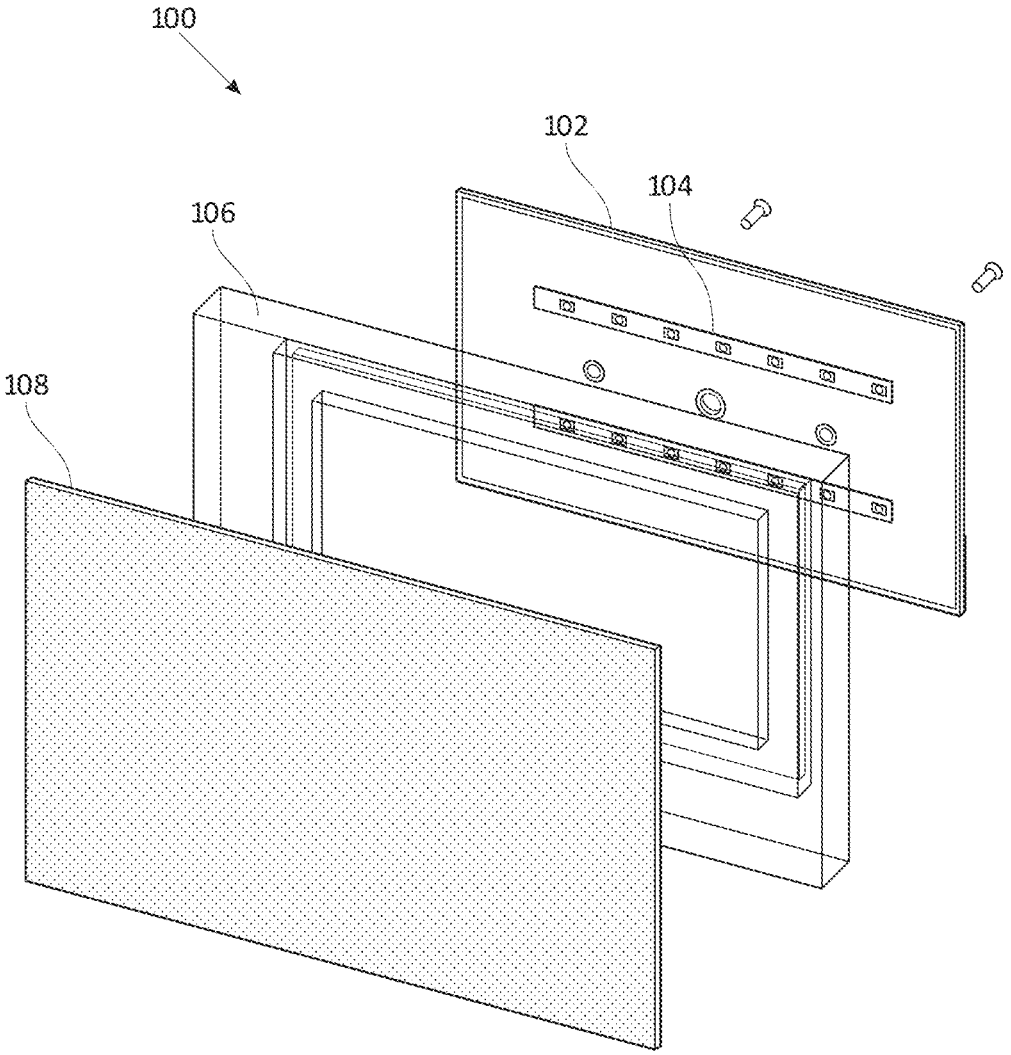
FIG. 1A is an exploded view of a sign assembly in accordance with the present disclosure.

An illustrative embodiment of the present disclosure relates to a customizable sign assembly with an illumination source.

FIGS. 1A through 12D, wherein like parts are designated by like reference numerals throughout, illustrate an example embodiment or embodiments of improved sign assembly, according to the present disclosure. Although the present disclosure will be described with reference to the example embodiment or embodiments illustrated in the figures, it should be understood that many alternative forms can embody the present disclosure. One of skill in the art will additionally appreciate different ways to alter the parameters of the embodiment(s) disclosed, such as the size, shape, or type of elements or materials, in a manner still in keeping with the spirit and scope of the present disclosure.

Referring to FIG. 1A, and exploded view of a sign assembly 100, in accordance with the present disclosure, is depicted.

In some embodiments, the sign assembly 100 can include an illumination panel 106 that can be eliminated by at least one light source to transmit and diffuse light from the light source 104. For example, the illumination panel 106 can be made from a transparent or translucent material, for example, glass, acrylic, urethane, polystyrene, polyethylene, urethane, olefin, silicon rubber or another suitable transparent material. The illumination panel 106 can be further colored, shaded or frosted to provide desired light diffusing effect. In some embodiments, the illumination panel 106 can be a precisely milled acrylic body that is translucent. In some embodiments, the rear of the illumination panel is opaque such that, when an opaque decorative panel is applied to the front surface of the illumination pane, the light only emanates from the sides of the illumination panel or through a cutout in the decorative panel, as is discussed below.

A clear acrylic can be used to purely transmit the colors of the internal light source 104. In some embodiments, the rear side of the illumination panel 106 can be coated, painted, constructed by a light blocking, reflective, and/or absorptive material. For example, the rear of the illumination panel 106 can be coated with a black non-translucent material. The usage of such a material can provide brighter illumination from the light source 104 out the front and/or side of the illumination panel 106.

In some embodiments, the acrylic edges of the illumination panel 106 can be frosted, for example, using abrasive blasting with first aluminum oxide and then glass bead for a cosmetic appearance. In some embodiments, the frosted edges can diffuse the light without significantly effecting the color. The illuminated edge(s) of the sign created by this combination of steps can attracts attention. Often there can be a significant clutter with multiple signs, notices, banners, temporary notifications, etc., such that when an informational or directional sign is required in a facility, the illuminated illumination panel 106 can ensure that the sign assembly of the present disclosure stands out.

The one or more light sources 104 can be mounted behind and/or within the illumination panel 106, for example, via screws, adhesive, etc. In some embodiments, the sign assembly 100 can include a back panel 102 having at least one light source 104 and corresponding power supply. The illumination panel may be connected to the illumination panel 106 to illuminate the illumination panel 106. The light source 104 can include any combination of light effects and efficiencies. For example, the light source 104 can include a full range of LED temperatures and colors from 2,400 k to 7,000 k, and rated for 50,000 hours. Similarly, the light source 104 can be coupled to any combination of hard wired or wireless power sources (not depicted) using any combination of power transfer. For example, the power source can be a plug and play electrical wiring using barrel connectors for connection to a UL rated power supply (e.g., with a NEMA power supply enclosure, 20 W pwr. Sup. and 10' of cable) within an enclosure of the back panel 102 for easy installation. Alternatively, the power source can be a battery power supply wired to the light source 104. The back panel 102 can also be configured with simple mounting hardware with access the power supply and light source 104.

In some embodiments, the back panel 102 can also include or be constructed from materials for enhancing the light emitting from the light source 104. For example, the back panel 102 can be constructed from a panel having a light diffractive film or coating. The back panel 102 or the illumination panel 106 can also include mounting holes, brackets, or other systems known in the art to provide vandal resistant mounting. For example, the basic back panel 102 can be furnished with a special fabricated aluminum mounting assembly that affixes to the wall and it can be able to sustain over 50 lbs of force. This is an advantageous because signs are frequently placed in public areas and subjected to theft. The back panel 102 can further include a WI-FI controller (not depicted) configured to operate with mobile app to control dimming and set on/off times for the light source 104.

In some embodiments, the sign assembly 100 can include a decorative panel 108 mounted on a face of the illumination panel 106. In some embodiments, the illumination panel 106 can be configured to enable light to emanate from the sides to cast a halo or a light band around the decorative panel 108 mounted thereon. In some embodiments, the illumination panel 106 can be made of a translucent material to permit light to emanate, transmit or diffuse through the illumination panel 106.

Figure 2:
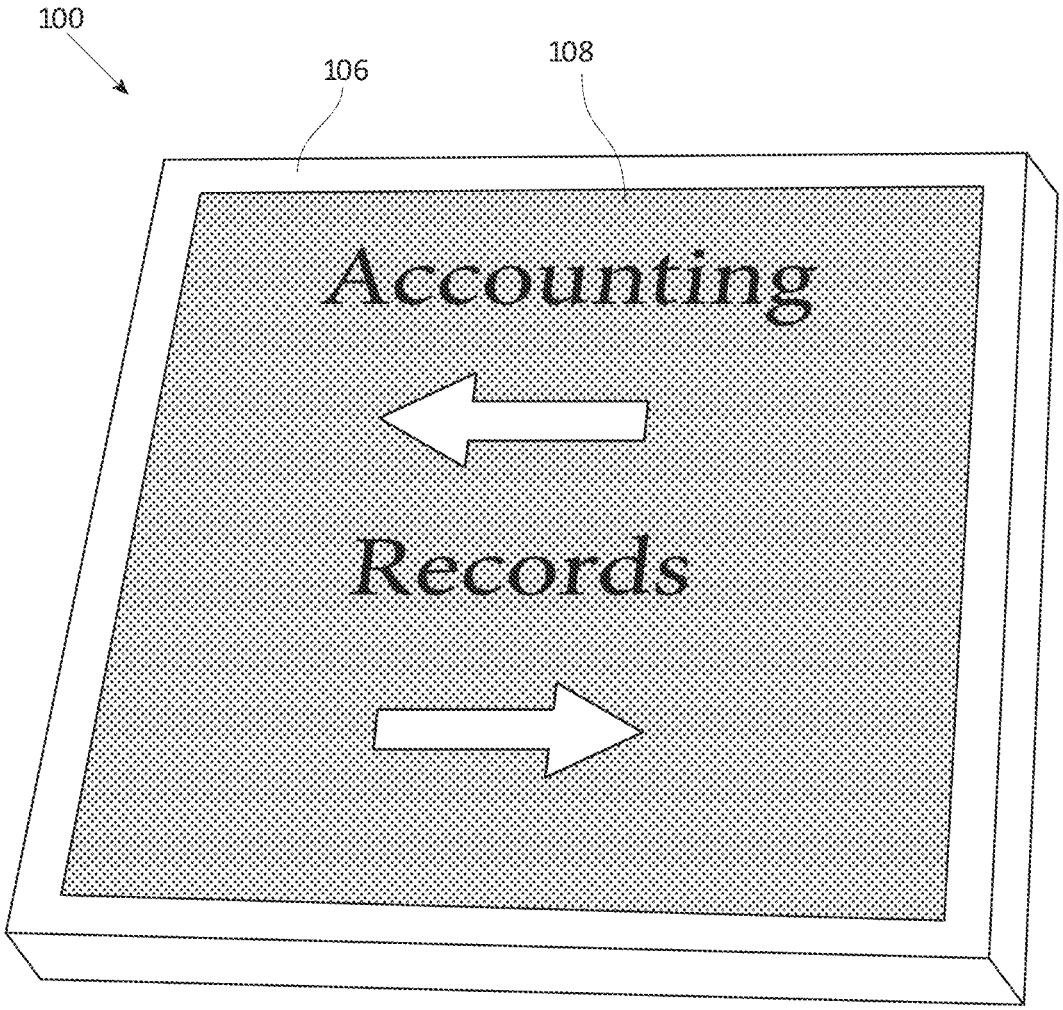
FIG. 2 and FIG. 3 show various embodiments of a sign assembly in accordance with the present disclosure.
Figure 3:
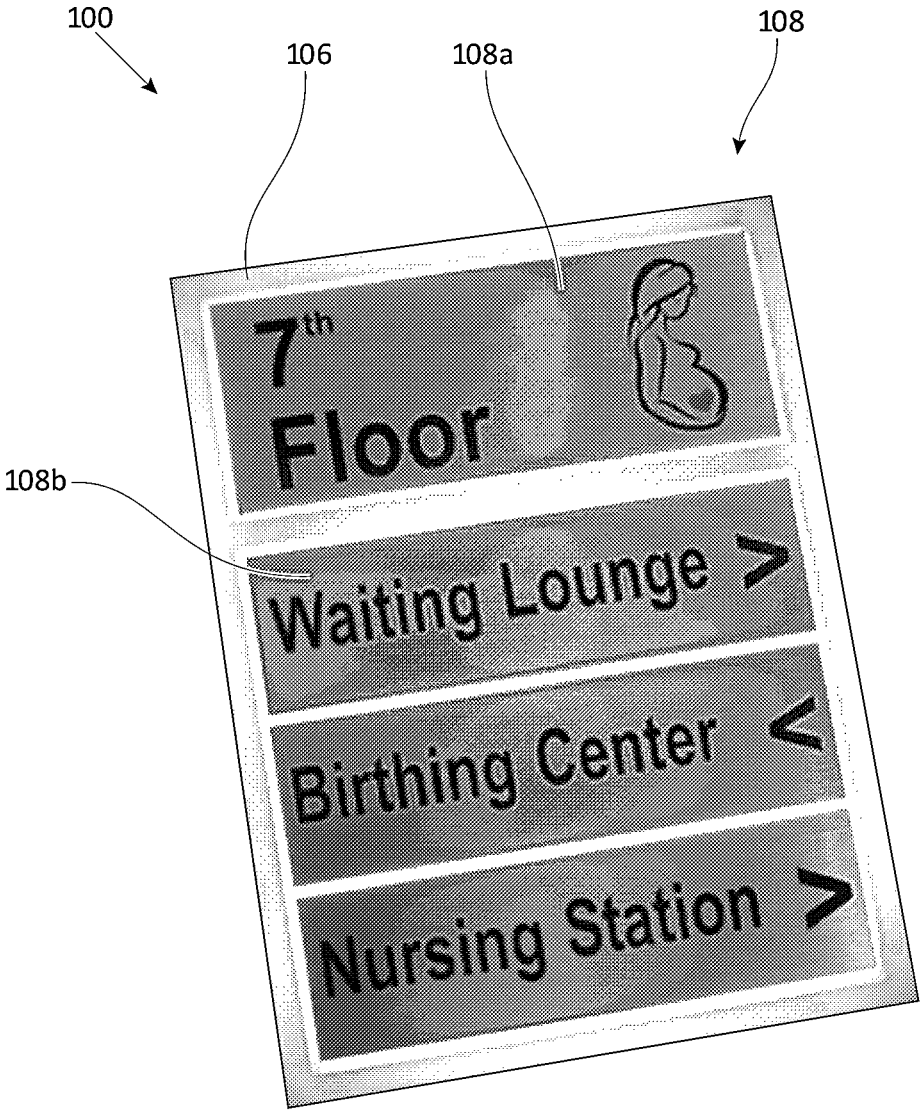

The decorative panel 108 can be sized and shaped as the same size as the face of the illumination panel 106, larger than the face of the illumination panel 106, smaller than the face of the illumination panel 106, or inlayed within the illumination panel 106. In some embodiments, as shown in FIG. 2, the illumination panel 106 may include a pocket sized to receive the decorative panel 108. In this manner, the illumination panel 106 may provide elimination around the front face of the decorative panel 108. In some embodiments, the decorative panel 108 may comprise a plurality of decorative panels 108*a*, 108*b*, as shown in FIG. 3.

The decorative panel 108 can be constructed using any combination of laminates, including but not limited to traditional architectural metal finishes, textured or embossed metal finishes, faux stone finishes, real wood veneer finishes, textured three-dimensional acrylic panels in Pantone Matching System (PMS) colors, integral dry erase board, chalkboard, and magnet message board. In some embodiments, the decorative panel is opaque, such that the light from the illumination panel 106 emanates from the sides of the illumination panel 106, rather than through the decorative panel 108, to form a light band about the decorative panel. In this manner, the decorative panel may enhance the light transmitting properties of the illumination panel. The decorative panel 108 can also be further enhanced by applying informational graphics, such as, engraving, indicia and/or graphics therein that provides desired information. For example, the decorative panel 108 can include any combination of etched and infilled graphics, direct digital print graphics, applique graphics, and braille raster. The decorative panel 108 can also include stencil cut graphics that are internally illuminated.

Figure 4A:
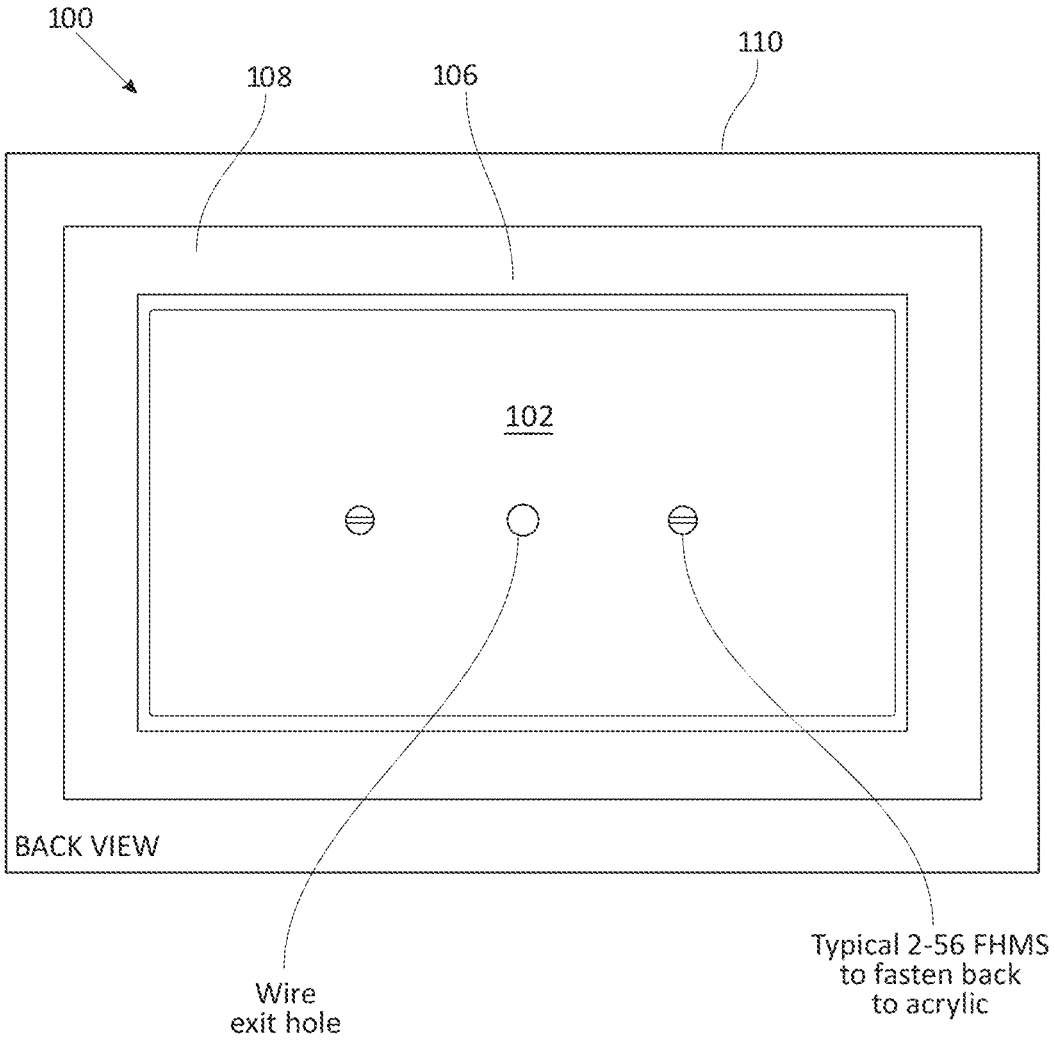
FIG. 4A and FIG. 4B shows an embodiment of a sign assembly in accordance with the present disclosure.
Figure 4B:
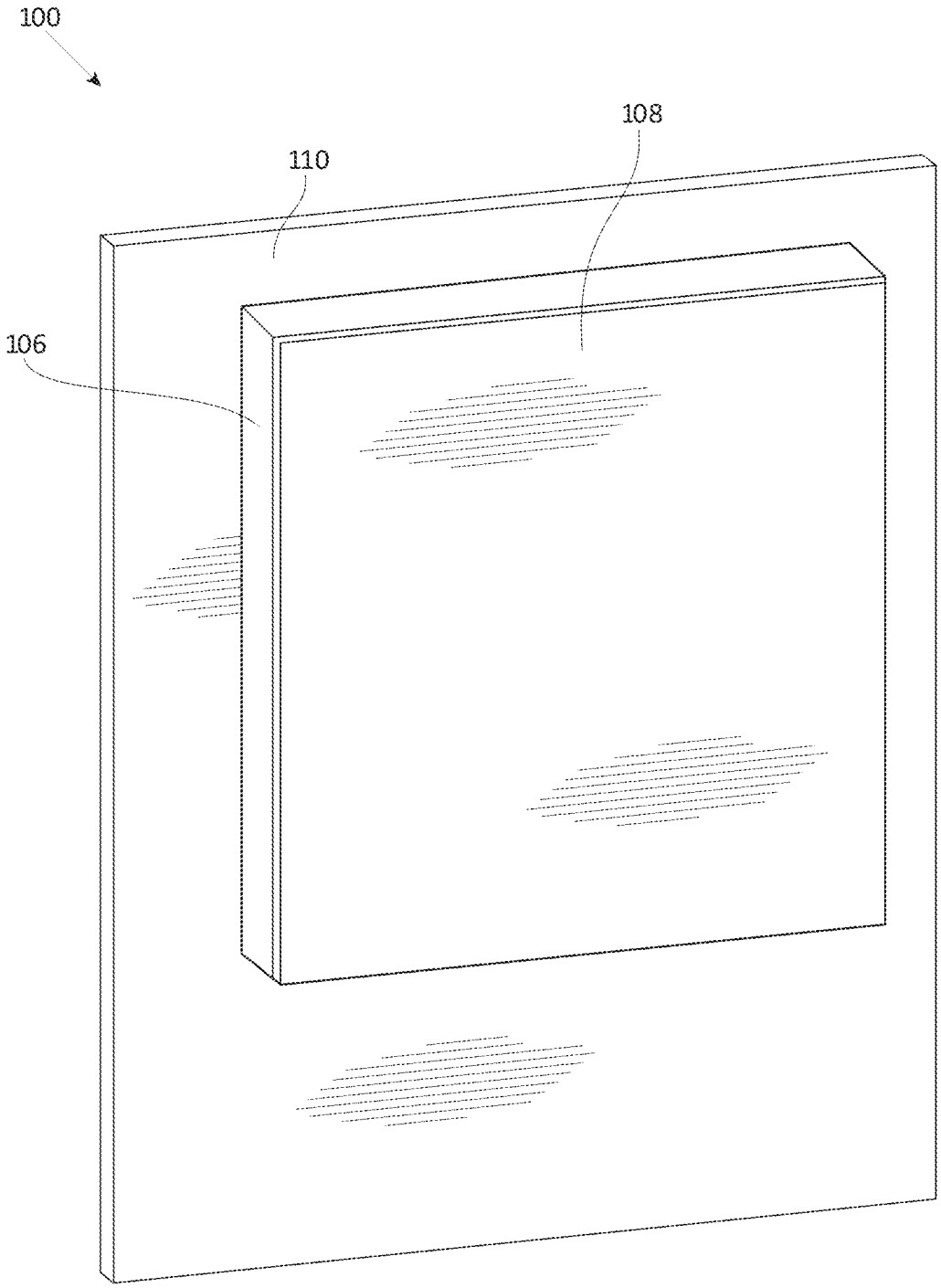

Referring to FIG. 4A and FIG. 4B, in some embodiments, the sign assembly 100 can also include a background panel 110, which similarly to the decorative panel 108, can be provided in many different designs, colors and sizes. In some embodiments, the background panel 110 can be textured or colored non-glare acrylic. The sign assembly 100 can also include other architectural embellishments and/or fabricated architectural frames. In some embodiments, the sign assembly 100 can be mounted on a rear decorative panel selected from the same materials as the decorative panel 108. In some embodiments, the components 102, 106, 108 can be mounted on the background panel 110. The components 102, 106, 108 can be mounted on the background panel 110 at any location, such as for example, at a centered position, at a corner position, off set position, on a side position, etc.

Figure 5:
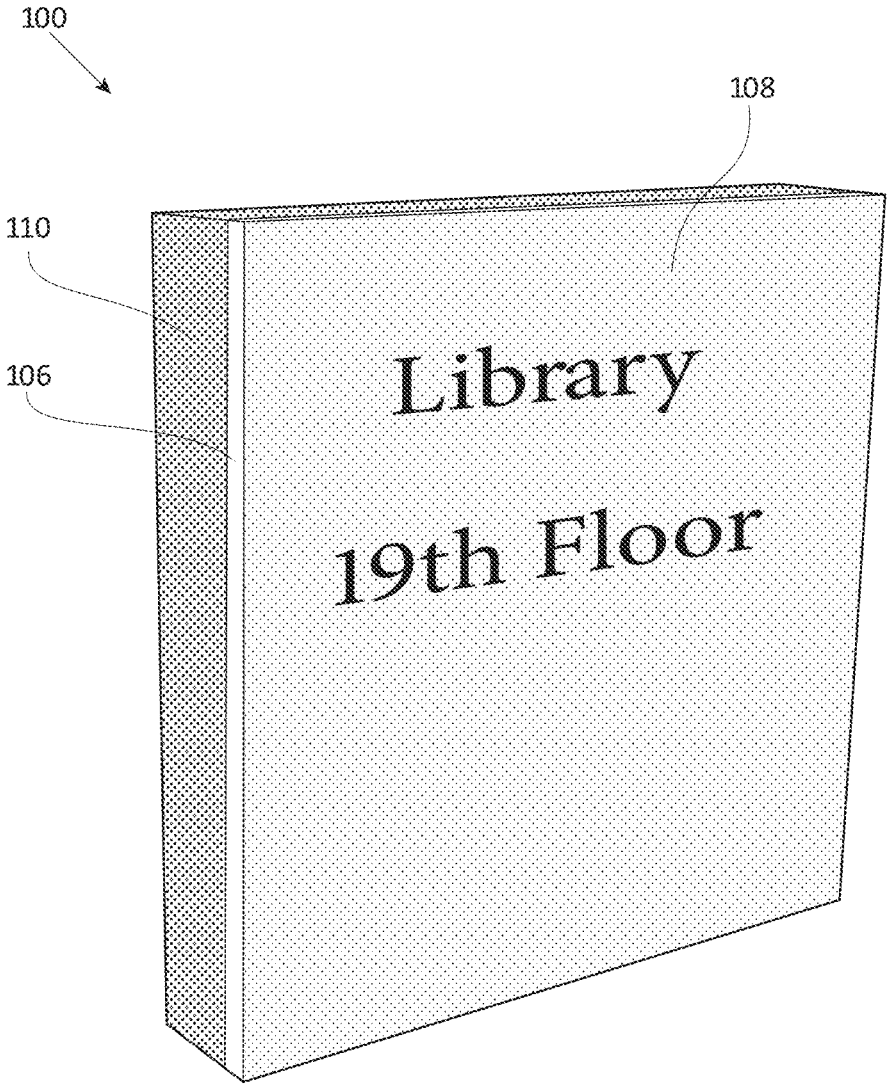
FIG. 5 shows an embodiment of a sign assembly in accordance with the present disclosure.

The background panel 110 can be selected from any combination of similar materials and designs as discussed with respect to the decorative panel 108. In some embodiments, as shown in FIG. 5, the background panel, the illumination panel 106 and the decorative panel can all have substantially the same size and shape. The recess 112, however, can be cut into the background panel 110 at any location.

Figure 6A:
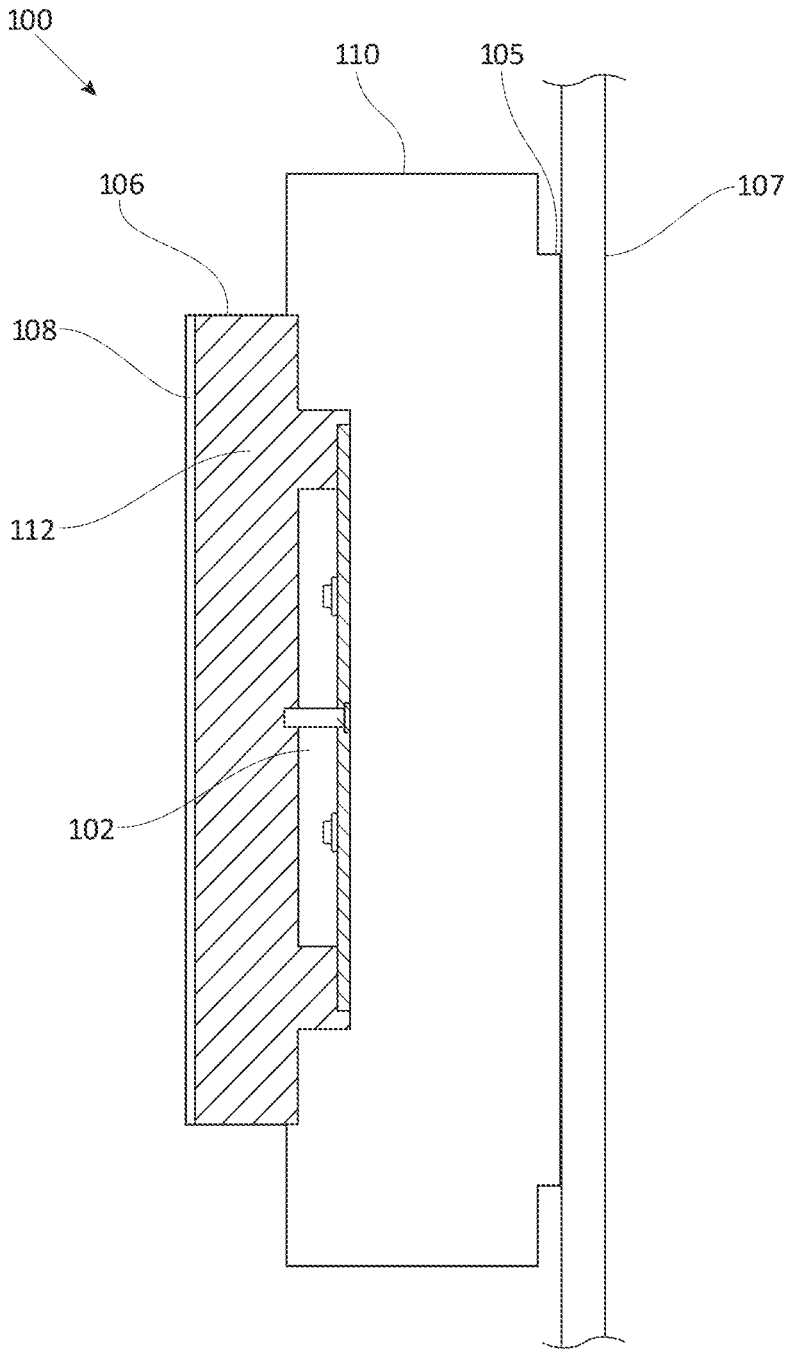
FIGS. 6A-6C shows an embodiment of a sign assembly in accordance with the present disclosure.
Figure 6B:
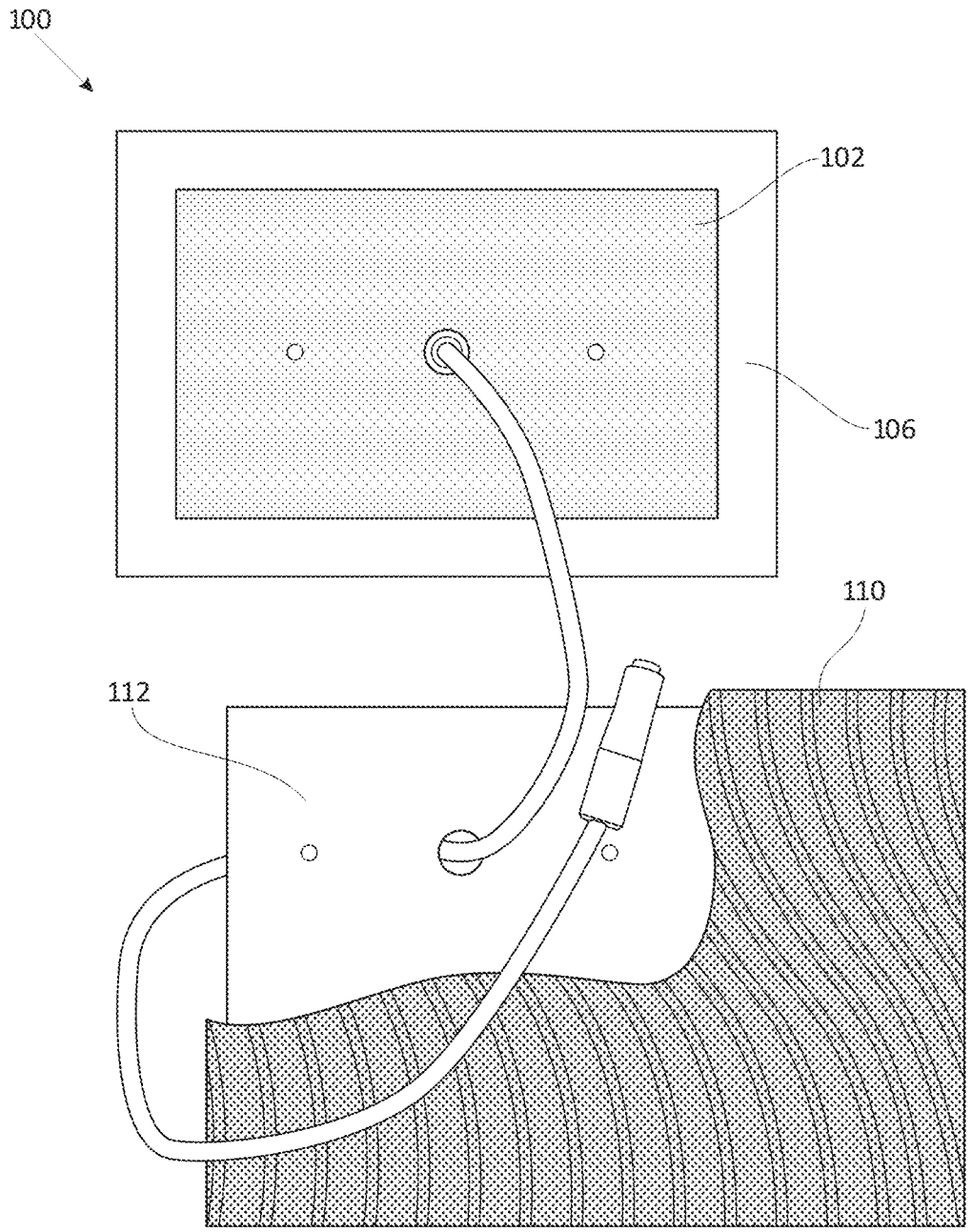
Figure 6C:
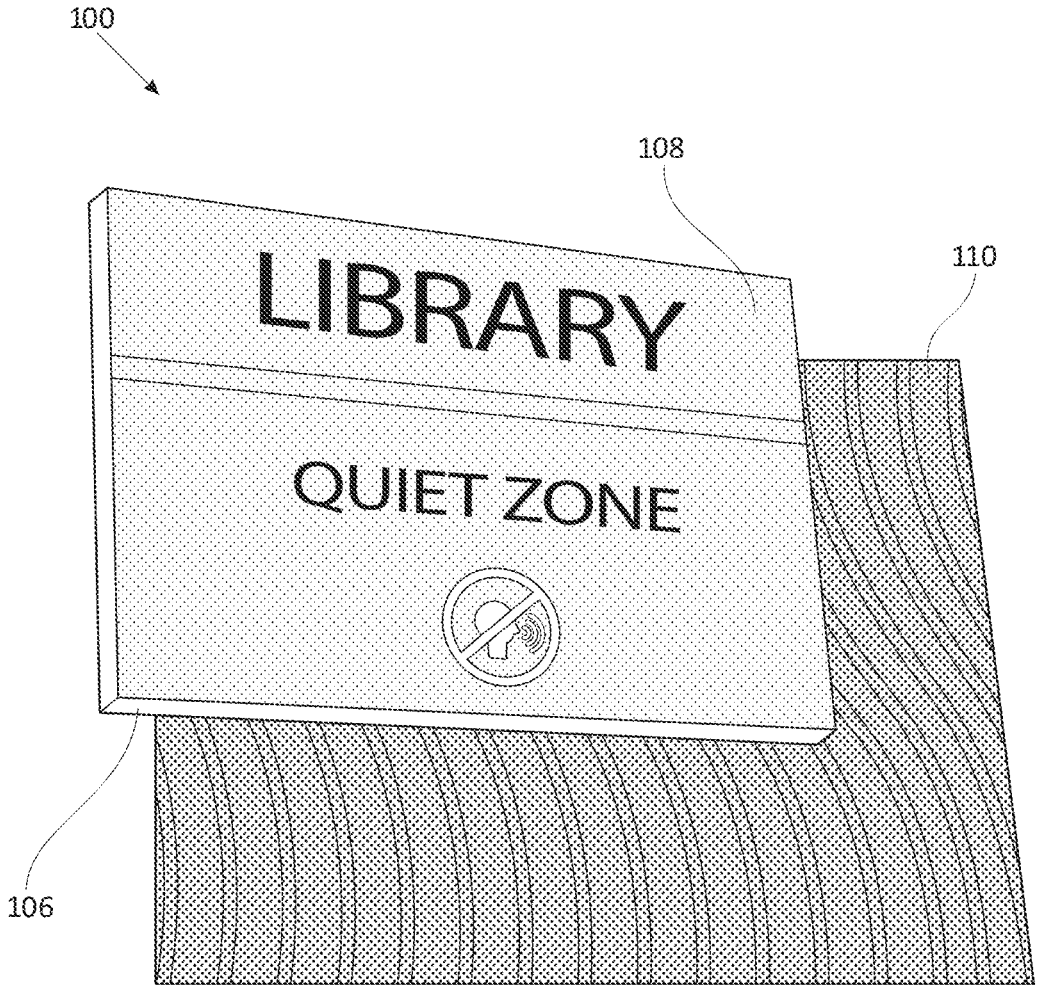
Figure 7A:
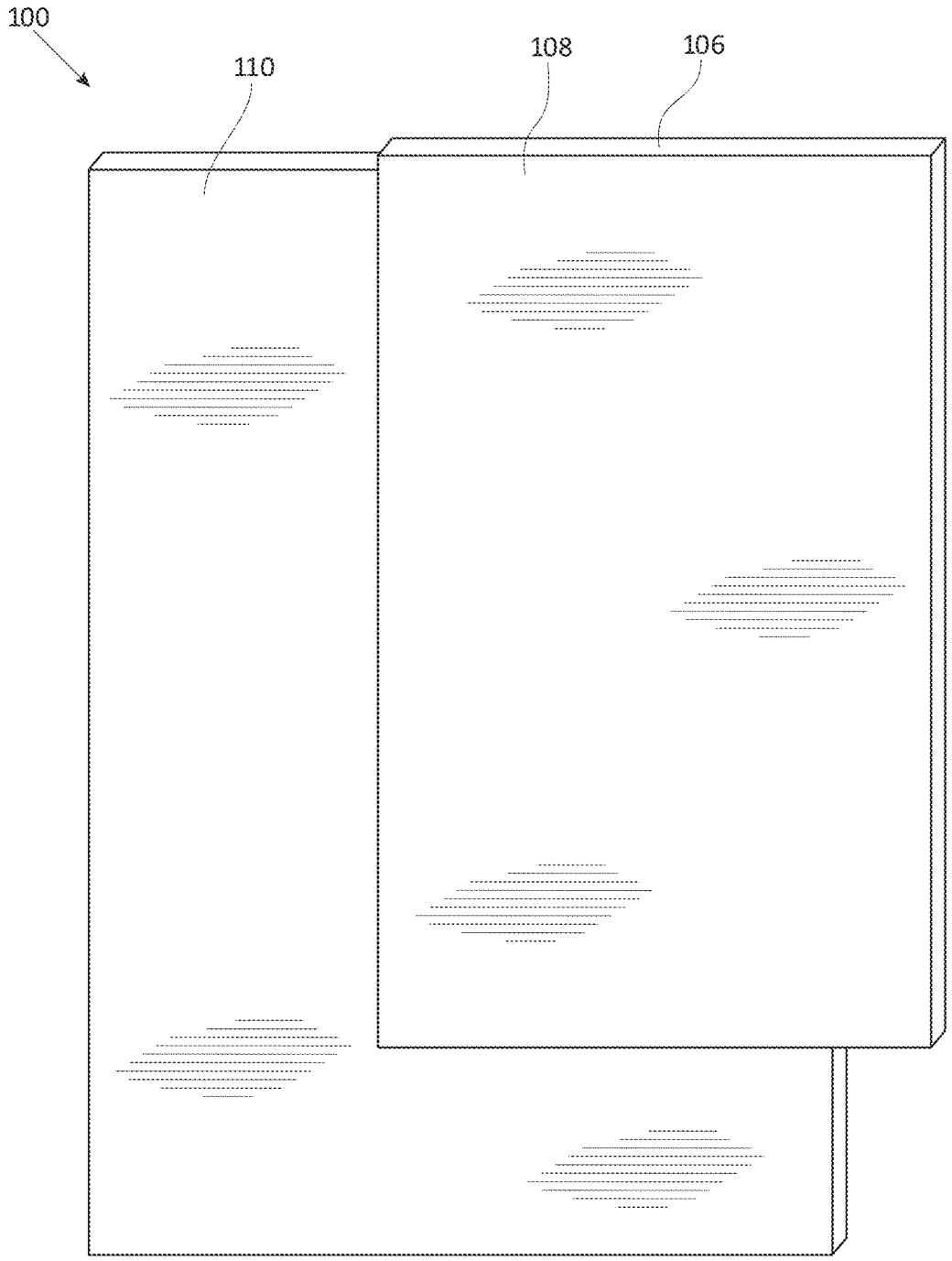
FIGS. 7A-7C illustrate various embodiments of a sign assembly in accordance with the present disclosure.
Figure 7B:
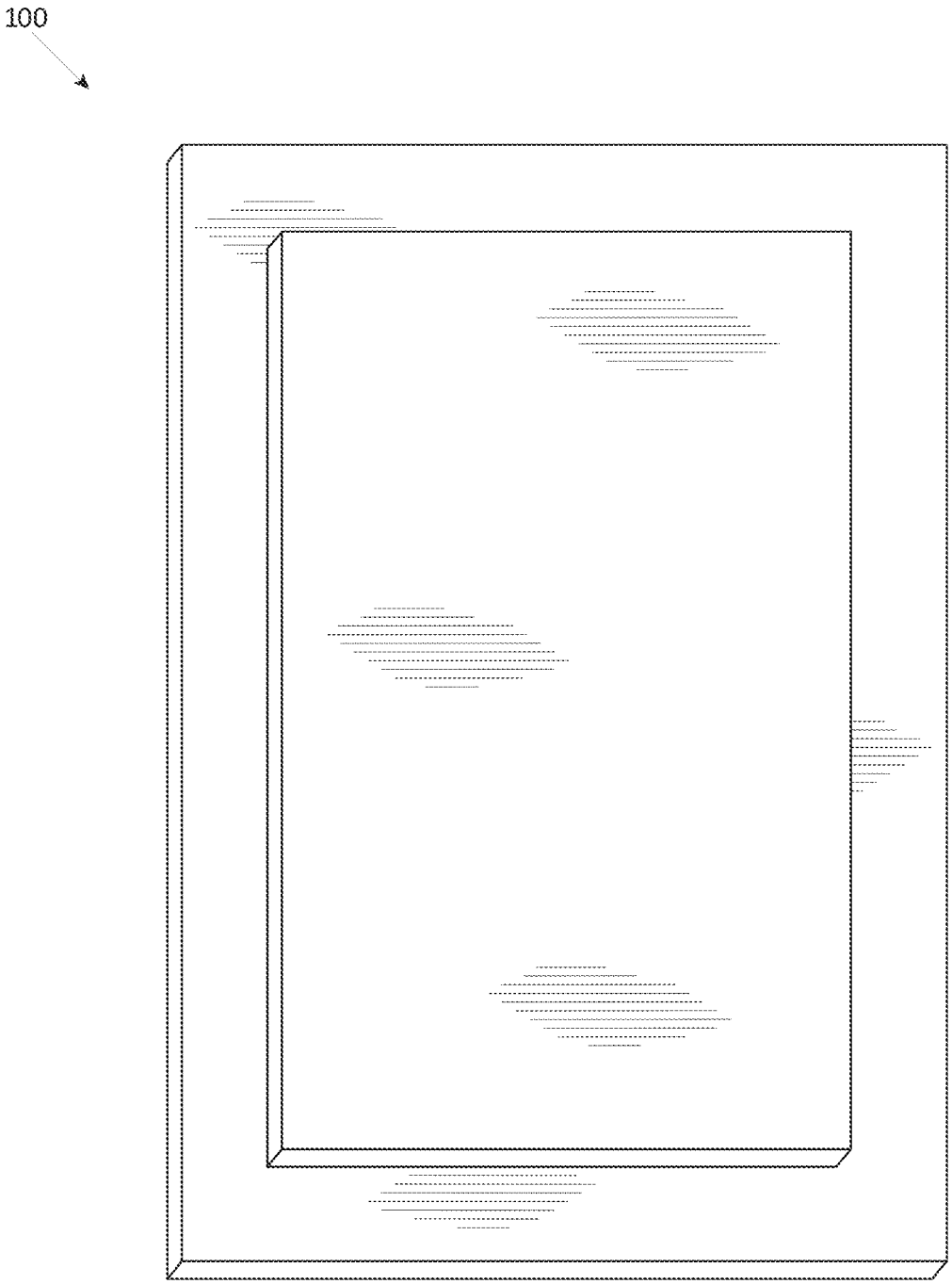
Figure 7C:
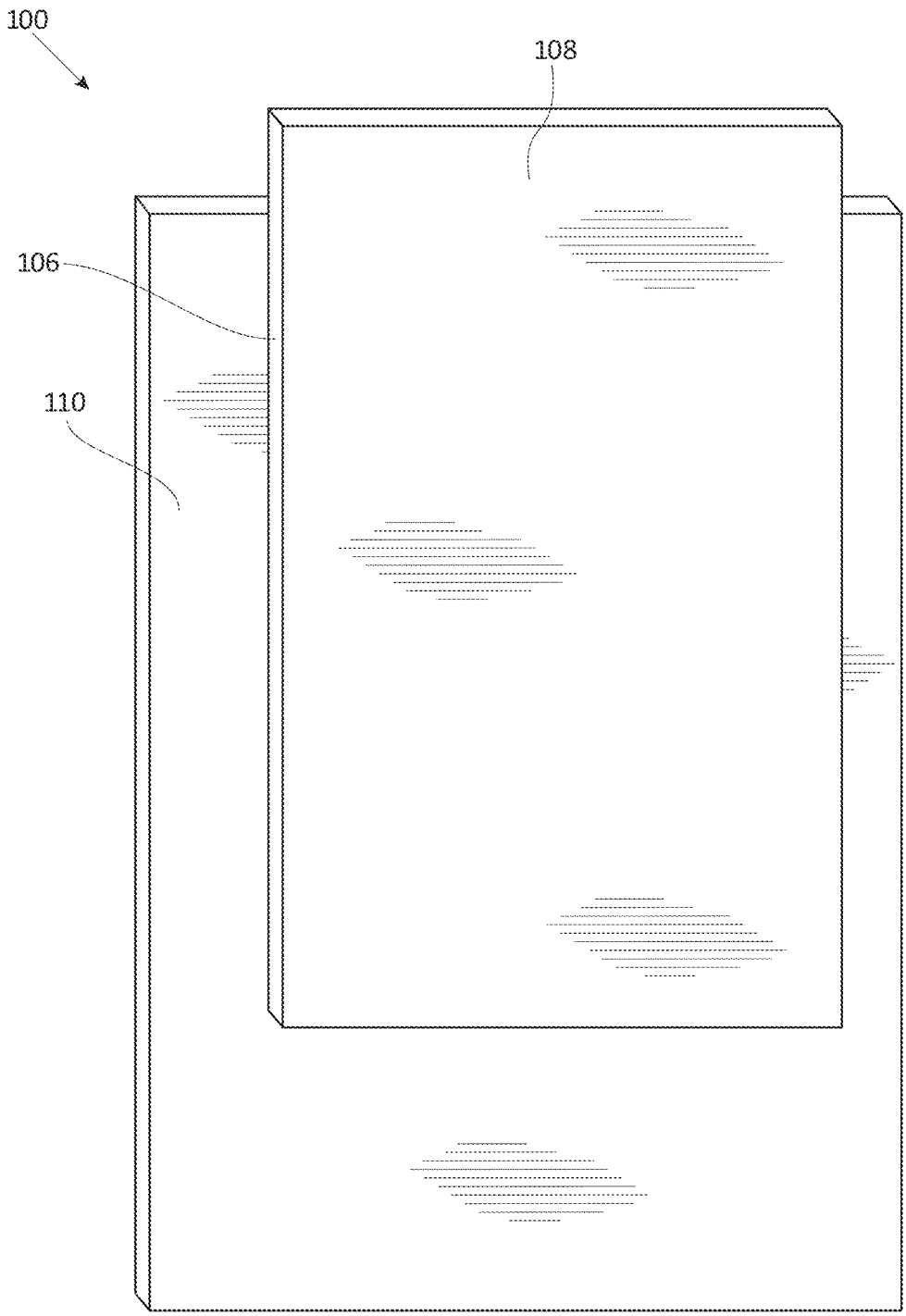

In reference to FIG. 6A, FIG. 6B and FIG. 6C, in some embodiments, the background panel 110 can include a recess 112 in which the back panel 102 and at least a portion of the illumination panel 106 can fit within the background panel. In some embodiments, when the illumination panel 106 is disposed in the recess 112, at least a portion of the illumination panel protrudes from the recess 112. In this manner, when the illumination panel 106 is illuminated, the portion of the illumination panel protruding from the recess can form a lighting effect about the decorative panel 108. In other words, the light emanating from the portion forms a band of light around the perimeter of the decorative panel 108. In some embodiments, the background panel 110 allows the back panel 102 to rest within the recess 112 such that the illumination panel 106 rest substantially flush on the surface of the background panel 110. In some embodiments, the recess may be sufficiently deep to receive the back panel 102 and substantially all of the illumination panel 106.

FIGS. 6B and 6C illustrate an unassembled view of the sign assembly 100 with the recess 112 cut at a corner position of the background panel 110. When the sign 100 is assembled, in some embodiment, the illumination panel 106 and the decorative panel 108 extend beyond the background panel 110. The recess 112, however, can be cut into the background panel 110 at any location. For example, it can be cut in a centered position, at a corner position, on a side position, etc. In some embodiments, the illumination panel 106 and/or decorative panel 108 rest are raised from the background panel 110.

Figure 1B:
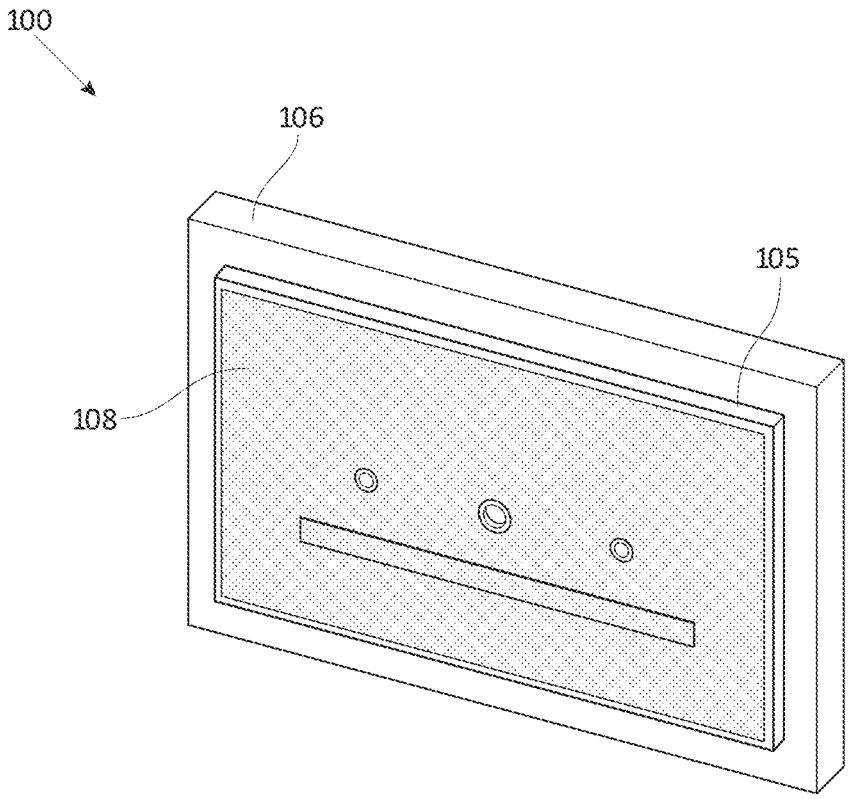
FIG. 1B is a rear view of a sign assembly in accordance with the present disclosure.

In reference to FIG. 1B and FIG. 6A, the wall mounting surface of the sign assembly 100 (such as surface of the illumination panel 106, the background panel 110 or the back panel 108) may include a projecting step 105 to create a space between the mounting surface of the sign assembly and a wall 107 to enhance the illumination effect and make the sign assembly 100 appear to be floating on the wall 107. For example, the rear panel may include a recessed (milled out) area surrounded by the projecting step. The light source may be placed into the recessed area. In some embodiments, the projecting step may be a raised lip or projection on the wall mounting surface of the sign assembly.

Referring to FIGS. 4A-7C, assembled views of the sign assembly 100 having a background panel 110 are depicted. As noted above, any combination of components 102, 106, 108, 110 sizes, locations and offsets can be utilized to construct the sign assembly 100 of the present disclosure. For example, the sign assembly may be a stand-alone design (no decorative panel), an edge wrap design, a corner wrap design, or a center or off-set mount design. In some embodiments, the sign assembly 100 may be provided with different designs using the components 102, 106, 108, 110 of the sign assembly 100 in different arrangements. In some embodiments, the illumination panel 106 and the decorative panel 108 are disposed within the perimeter of the background panel 110. In some embodiments, the illumination panel 106 and the decorative panel 108 can extend beyond the perimeter of the background panel 110. Some examples include the sign assembly 100 with the components 102, 106, 108 assembled in the center of the background panel 110. The light can emanate from the sides of the sign assembly 100 to cast a band of light around the raised panel. In some embodiments, the components 102, 106, 108 of the sign assembly 100 can be adapted to wrap around the side of the background panel 110. The light can emanate from the sides of the sign assembly 100 to cast a band of light both around the raised panel and the wall on one side. In some embodiments, the components 102, 106, 108 of the sign assembly 100 can be adapted to wrap around the top (or bottom) and side of the background panel 110. The light can emanate from the sides of the sign assembly 100 to project of a light band both around the raised panel and the wall on top (or bottom) and one side. In some embodiments, one or more of the components 102, 106, 108, 110 may be arranged at an angle relative to one or more of the other components.

Figure 8:
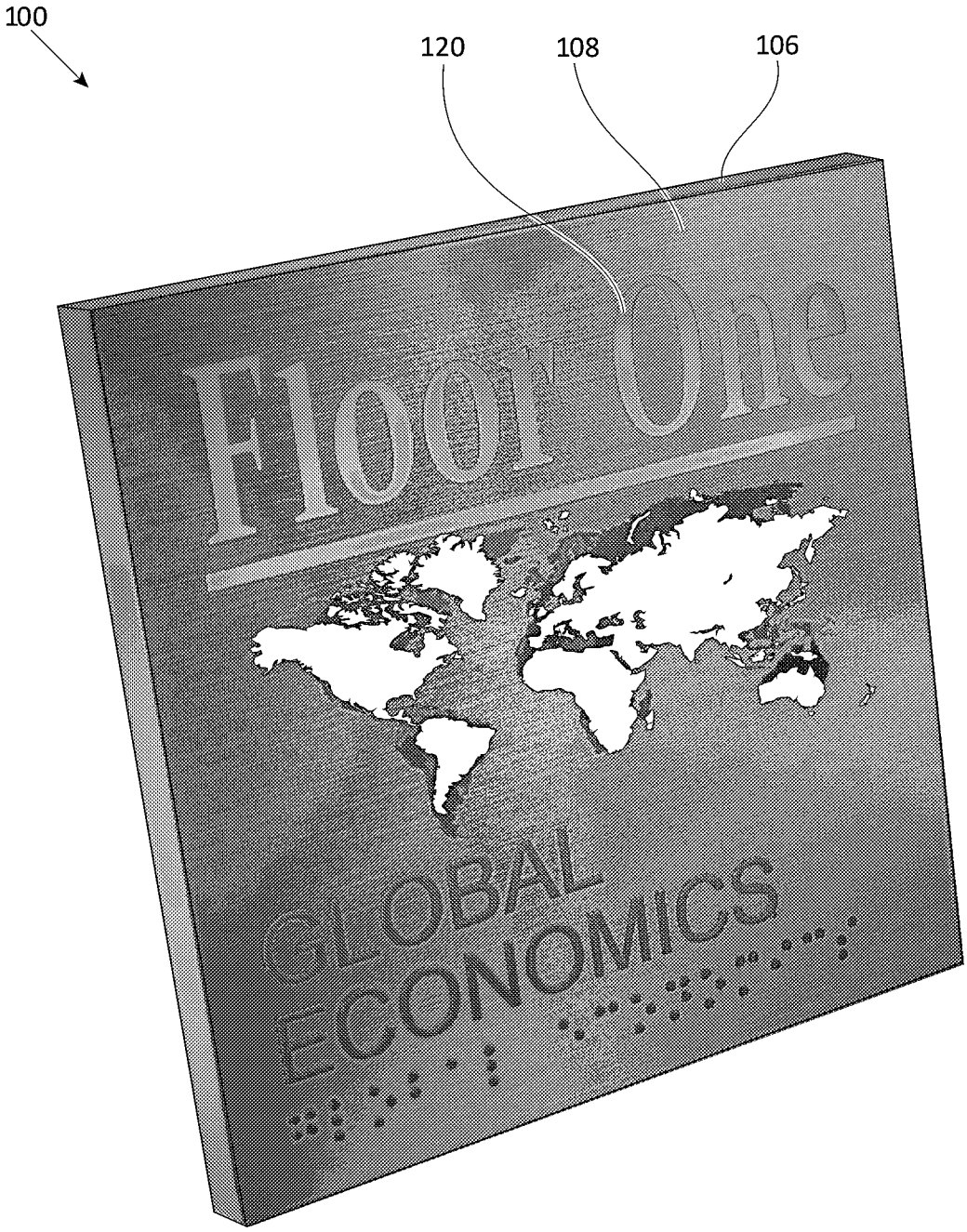
FIG. 8 shows an embodiment of a sign assembly in accordance with the present disclosure.
Figure 9A:
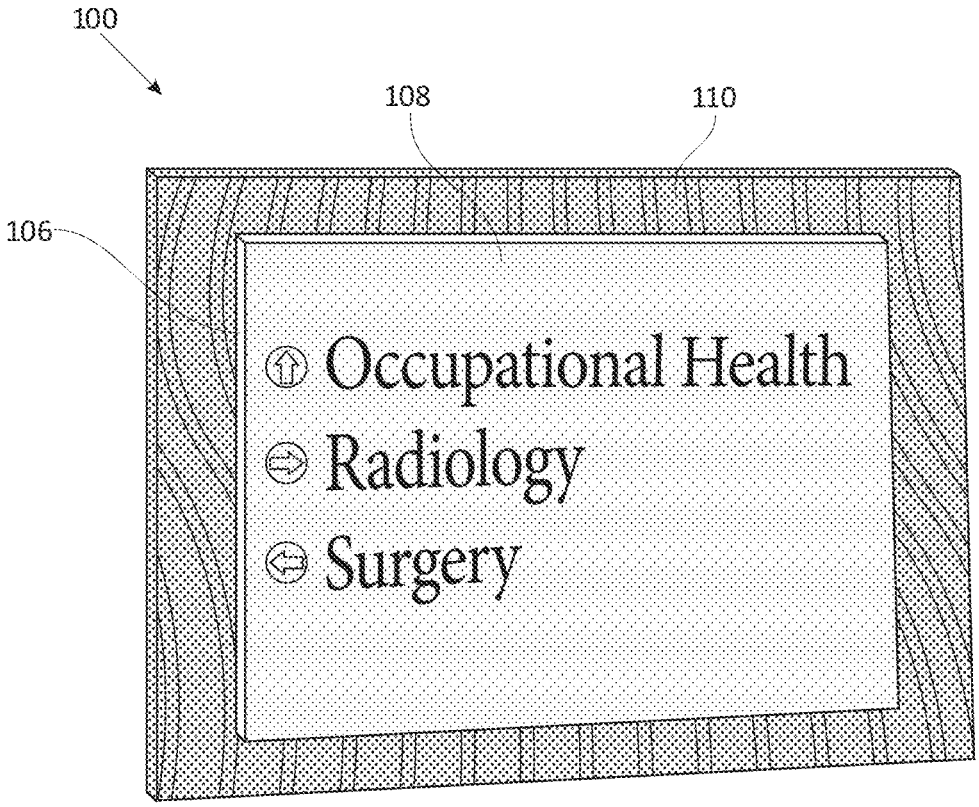
FIGS. 9A-9D illustrate various embodiments of a sign assembly in accordance with the present disclosure.
Figure 9B:
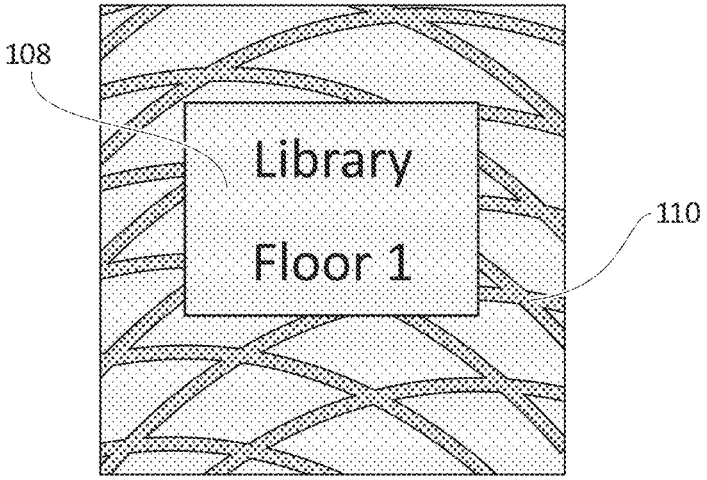
Figure 9C:
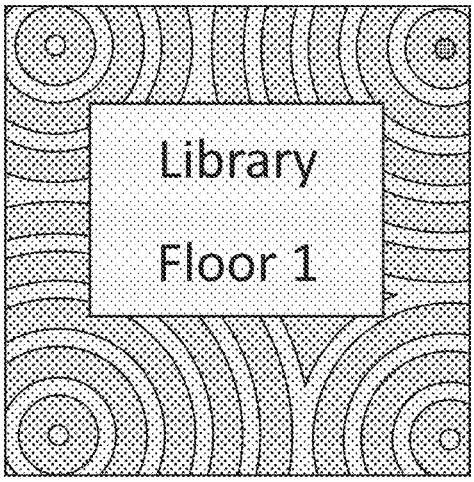
Figure 9D:
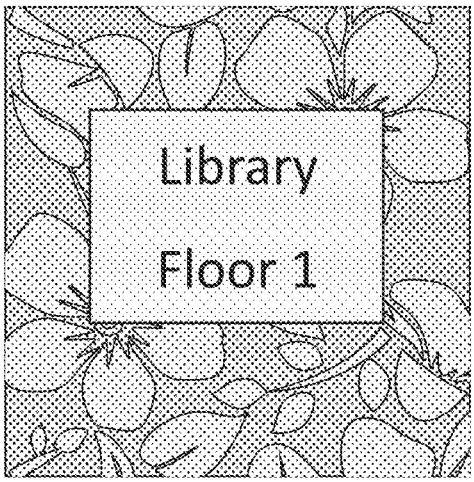

Referring to FIG. 8, in some embodiments, the decorative panel 108 can include a cutout 120, exposing the illumination panel 106 underneath the decorative panel 108. In some embodiments, the illumination panel 106 allows light to pass through and/or diffuse through the cutout 120, such that, the cutout 120 will expose the light from underneath the decorative panel 108. The cutout 120 can be in a form of stenciled graphics, such as letters, numbers, graphics or a combination thereof cut into the decorative panel. In some embodiments, a light transmitting element 127 may be disposed in the cutout to be illuminated. In some embodiments, the decorative panel 108 can include a combination of lettering effects thereon, for example, to supplement the information illuminated in the cut-out 120. For example, the decorative panel can include a backlit cutout 120, but also graphics and text printed, layered, engraved, etc. on the decorative panel 108, as shown in FIG. 8. In this manner, the sign assembly 100 can highlight certain information printed on the decorative panel 108.

As noted above, each of the components 102, 106, 108, 110 of the sign assembly 100 can be constructed from various materials, textures, colors, and patterns. In some embodiments, as shown in FIGS. 9A-9D, the background panel 110 may include various textured designs. In some embodiments, such textured design can provide an additional decorative illumination effect. In some embodiments, the textured designs by themselves, or in combination with the color of the textured background panel, can enhance the lighting effect produced by the light emanating from the illumination panel 106.

Figure 10:
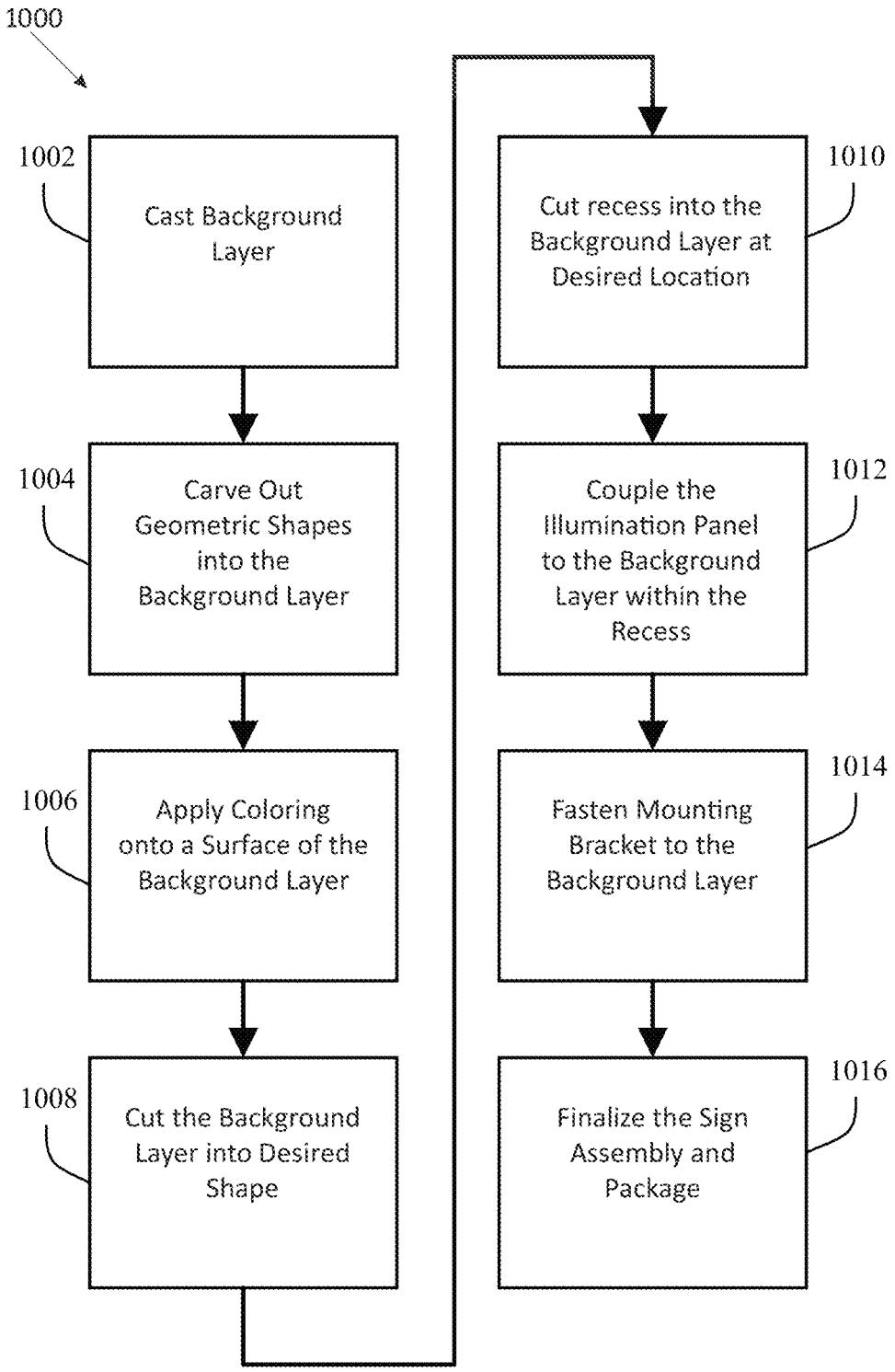
FIG. 10 depicts an exemplary flow chart showing a process for creating a sign assembly in accordance with the present disclosure.

Referring to FIG. 10, an exemplary flow chart depicting an example process for manufacturing a sign assembly the present disclosure. Specifically, FIG. 10 depicts an exemplary flow chart showing the process 1000 for creating a sign assembly 100 including the optional background panel 110 that includes an acrylic background with texturing.

At step 1002 a cast is poured for the background panel 110. In some embodiments, the background panel 110 can be cast from a clear non-glare finished acrylic. In some embodiments, an acrylic having one or more color may be used. The background panel 110 can be cast in a mold designed for any combination of dimensions, for example, in a 48" (L)×48" (W)×2.5"(D) mold. At step 1004 geometric shapes can be carved/etched into the surface of the background panel 110 to give it a textured surface. For example, the background panel 110 can be etched with shapes such as waves, straight lines, wood grain, or similar design as shown in FIGS. 9A-9D. The shapes can be carved using any combination of methods, for example, using a dual head router to route the desired shapes. At step 1006, a coloring layer can be applied to a rear surface (opposite surface of the carved/etched geometric shapes) of the background panel 110, to either provide color to a clear acrylic or enhance color for a colored acrylic. The coloring layer can include any combination of solid, patterned, colored material to provide a desired aesthetic to the background panel 110. For example, a colored vinyl can be applied to the surface of the background panel 110. In some embodiments, the coloring layers of different colors can be applied to different sections of the background panel 110.

At step 1008 the background panel 110 can optionally be cut down to a desired size and shape. The background panel 110 can be cut down using any combination of methods, for example using a layer cutter. At step 1010 the recess 112 can be cut into the background panel at a desired location. The recess 112 is cut at a depth which is less than a total depth of the background panel, for example, as depicted in FIGS. 6B and 6C. The recess 112 is dimensioned to receive the back panel 102 such that the back panel 102 will rest entirely within the recess 112 to allow the illumination panel 106 to sit flush on the background panel 110. In some embodiments, the recess 112 can include mounting holes for coupling the back panel 102. At step 1012 the back panel 102 is coupled to the background panel 110 within the recess 112. The back panel 102 can be coupled to the background panel 110 using any combination of methods, for example, adhesives, mechanical fasteners, etc.

At step 1014 a mounting bracket is mounted to the background panel 110. In some embodiments, the mounting bracket can include a combination of vandal resistant hardware fastened to the edge of the recess 112, for example at six locations. At step 1016 the final assembly and packaging of the sign assembly 100 can be performed. In some embodiments, the final assembly can include disassembling each of the previously assembled components, applying a finish (e.g., clear coat, paint, etc.) to those components, and reassembling the components. Once assembled the sign assembly 100 can be inspected, tested, and packaged for shipping.

Figure 11A:
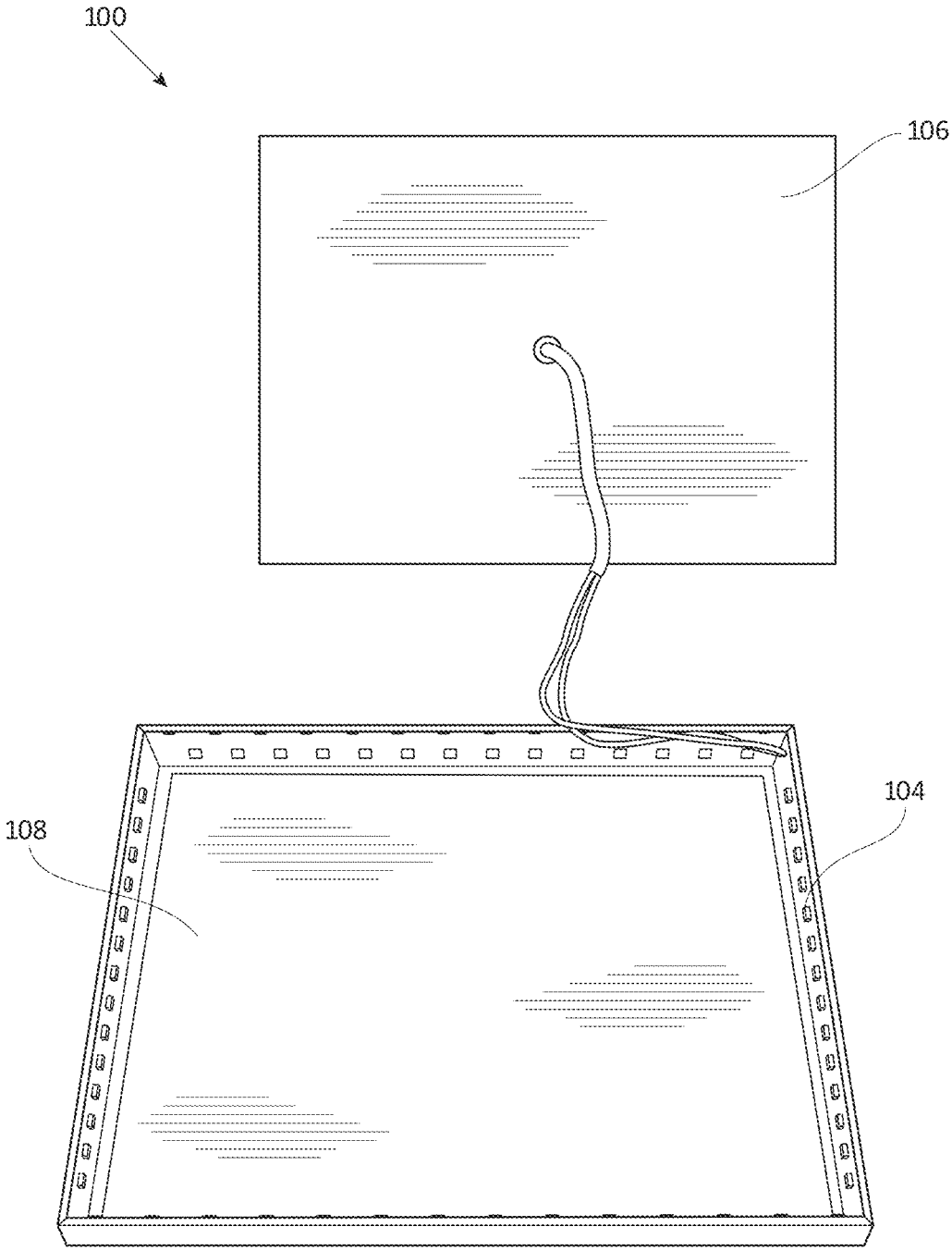
FIGS. 11A-11C show an embodiment of a sign assembly in accordance with the present disclosure.
Figure 11B:
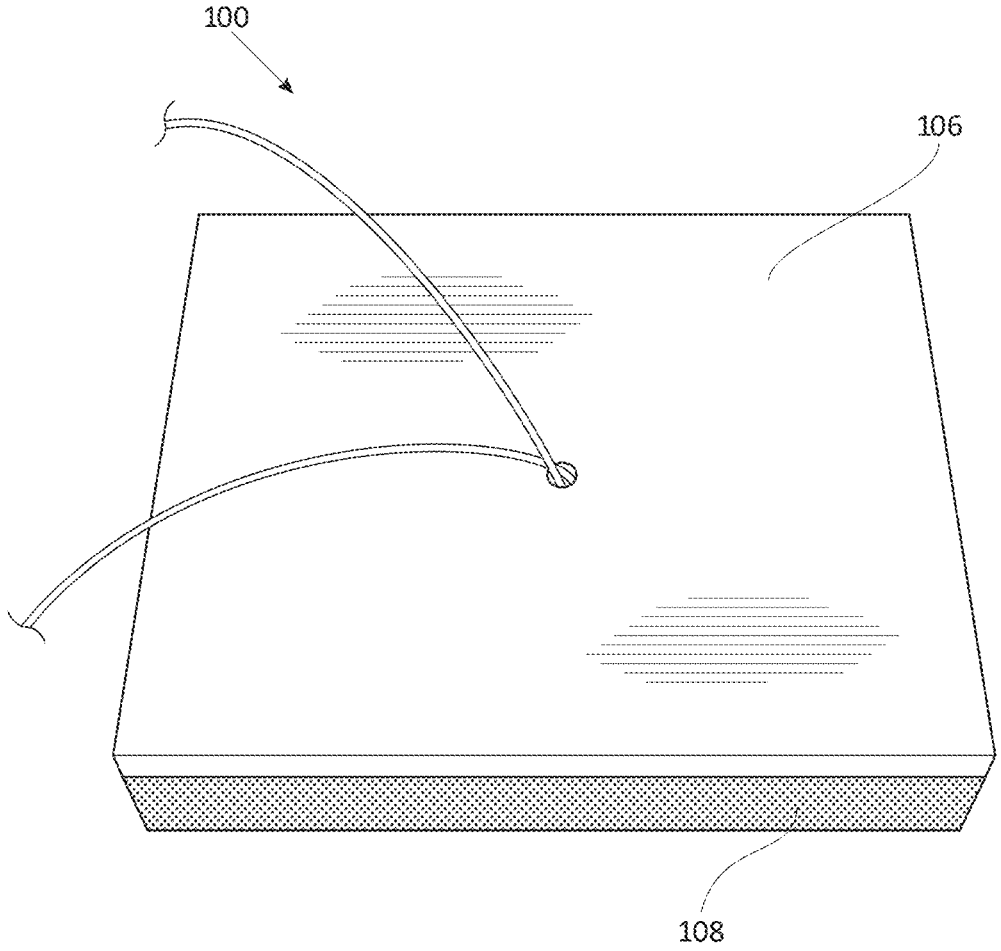
Figure 11C:
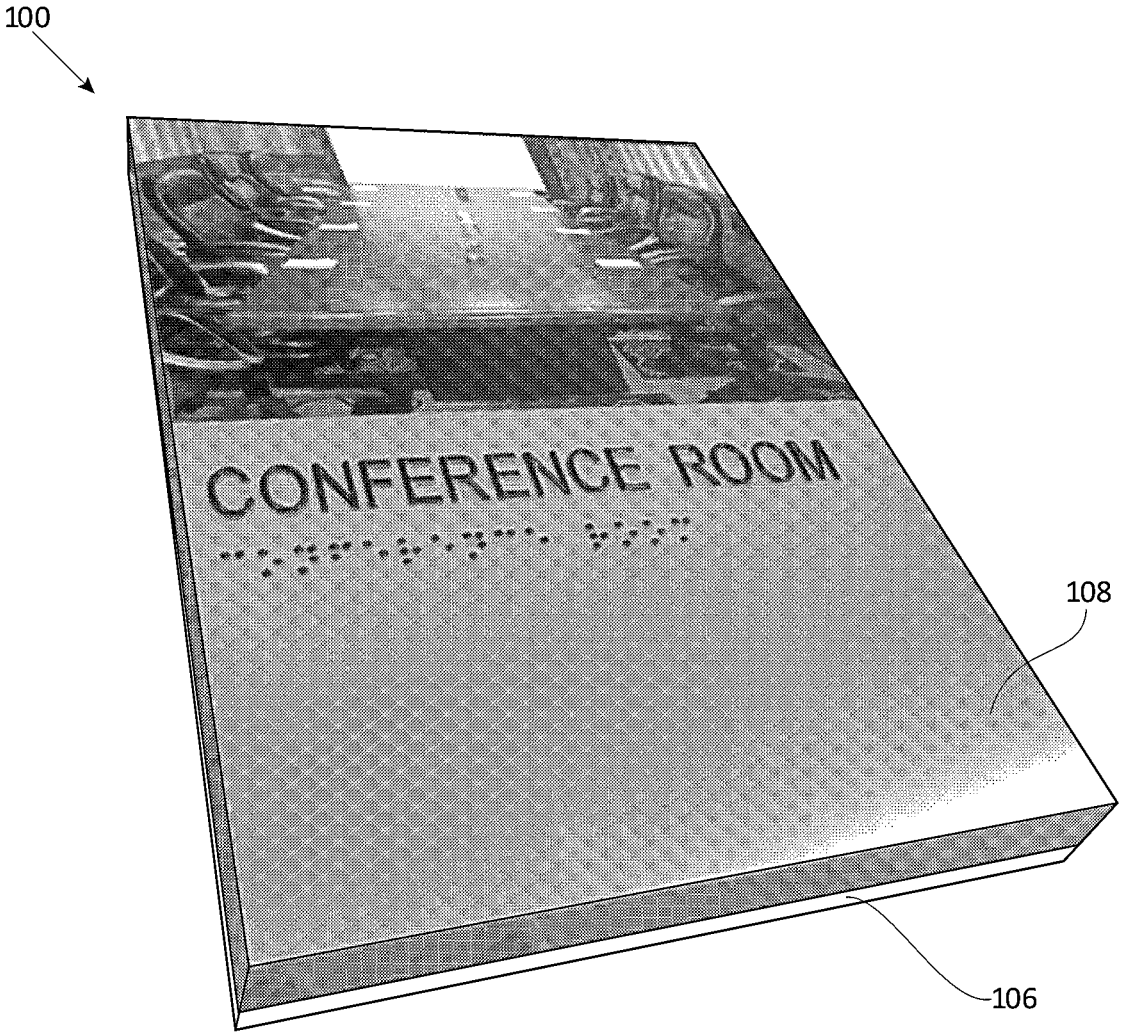

Referring to FIGS. 11A, 11B and 11C, in some embodiments, the sign assembly 100 can include a three-dimensional decorative panel 108 that has a lighting source 104 incorporated therein. For example, the decorative panel 108 can be an open-ended box that includes LED lighting adhered to the sidewalls of the box, as shown in FIG. 11A. The decorative panel 108 can be constructed from any combination of materials, for example metal, plastic, wood, etc. For example, the decorative panel 108 can be constructed from aluminum.

In some embodiments, the front and sides of the decorative panel 108 can include graphical designs printed thereon. The graphical designs can include any combination of vinyl, ink, etching, etc. In some embodiments, the graphical designs can be reinforced with a combination of illuminated graphics, printed Braille lettering, rasters, etc. FIG. 11C is a front view of a sign assembly 100 with graphics, raised text, and Braille text. In some embodiments, the graphical designs can be applied using a direct print digital technique. For example, an extremely accurate inkjet machine specializing in reproducing extremely small and sharp lettering and general graphics, can be used to print directly on a surface of the decorative panel 108 (after specialized treatment) without the use of vinyl media. This printing can then immediately be cured thru the use of UV light. A printer can be used that makes CMYK color matching possible, for example, using available 12 inks in combination. Although printed graphics is provided as an example, any combination of graphics methods and mediums can be used without departing from the scope of the present disclosure. In some embodiments, the graphical designs itself can be portrayed on all four visible surfaces, for example, front and the four sides of that decorative panel 108. The graphical designs can also include a clear layer for enhancing and/or protecting the graphics, for example, a clear overcoat.

In some embodiments, the decorative panel 108 can be combined with the illumination panel 106 to form an illuminated sign assembly. In some embodiments, the light source 104 may be disposed on the illumination panel 106, in addition to or instead of the lighting source in the decorative panel. In some embodiments, the illumination panel 106 can include a cutout for a power source, for example, batteries, hard wires, solar cell, etc. for the light source to provide power to the light source 104. The illumination panel 106 can be made from any of the materials described above in connection with the housing 126. The illumination panel 106 can be designed to enable light to emit from the lighting source 104 from within the decorative panel 108 to the sides, rear, front, or combination thereof of the decorative panel 108.

The illumination panel 106 can be coupled to the decorative panel 108 using any combination of methods. For example, the illumination panel 106 can be a 0.5" thick clear acrylic that has been milled to seat into the decorative panel 108. The acrylic can then be sealed semi-permanently into the decorative panel 108 using cyanoacrylate adhesive. In some embodiments, while LEDs light sources 104 rated for 50,000 hours can be used, reducing the need for maintenance, if the sign itself is still serviceable, but needing maintenance at that time, the acrylic illumination panel 106 can still be removed to access the light sources 104 for replacement. The illumination panel 106 can also be designed to be removably attached to the decorative panel, for example, by fasteners and/or a friction fit (e.g., screws, tabs, adhesives, hinges, etc.).

In some embodiments, when joined with the decorative panel 108, at least a portion of the sidewalls of the formed enclosure is formed by at least part of the decorative panel 108 and the illumination panel 106, as shown in FIG. 11C. In other words, the sides of the sign assembly 100 can be partially constructed from the sides of the decorative panel 108 and the remaining portion of the sign's side can be constructed from the sides of the illumination panel 106, thus enabling a side lighting/backlighting effect. The sides of the decorative panel 108 and the illumination panel 106 can be flush or offset to provide different effects. For example, the decorative panel 108 can overhang the illumination panel 106, as depicted in FIG. 11C.

In reference to FIGS. 12A-12D, in some embodiments, the decorative panel 108 can include a cutout 120 to enable lighting from the lighting source 104 to emanate therethrough. In some embodiments, the cutout 120 can be in a form of letters, numbers, graphics or combination thereof.

In some embodiments, an light transmitting insert 127 may be disposed in the cutout to be illuminated. In some embodiments, the insert 127 can be designed to correspond to a cutout 120 portion of the decorative panel 108. The element 127 can also be flush with, recessed to, or a combination of flush, recessed, and raised within the cutout 120. In some embodiments, the insert 127 can be made from a translucent or light emitting material so it can be eliminated by the light source 104.

Figure 12A:
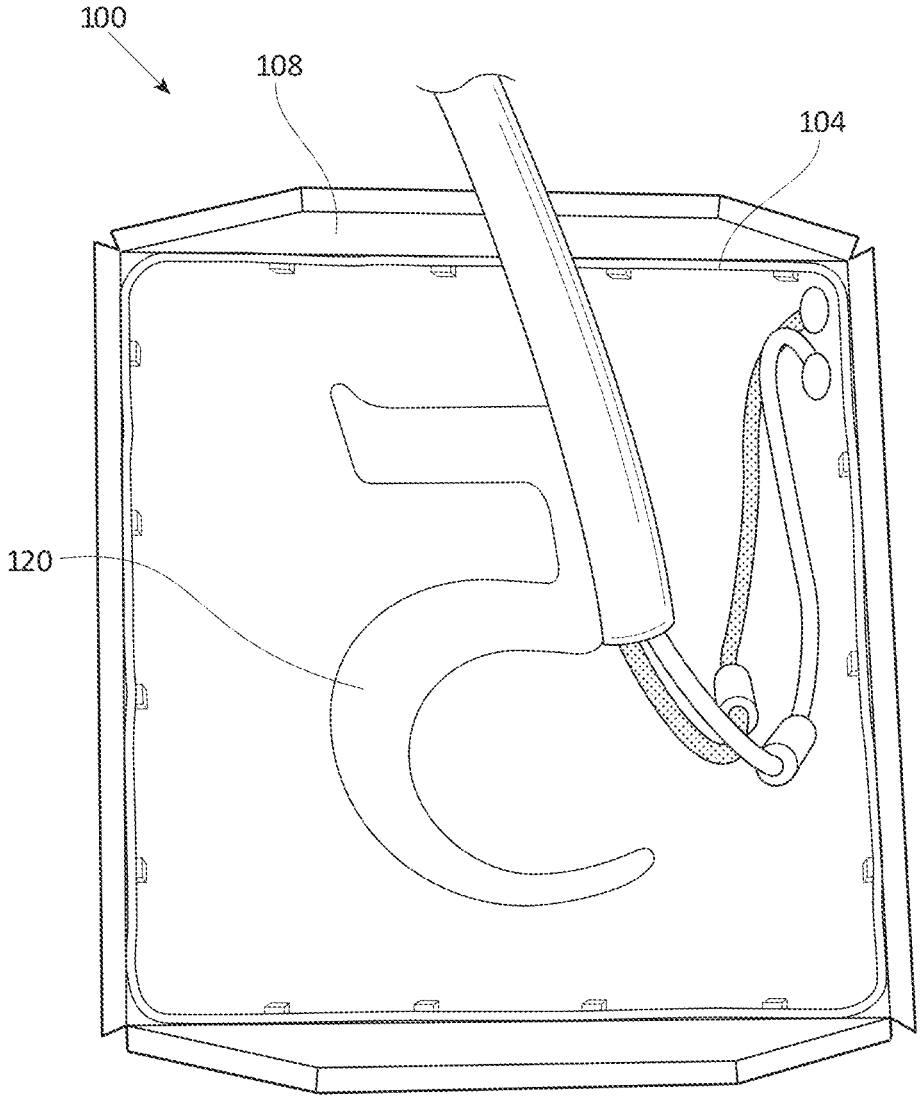
FIGS. 12A-12D illustrate various embodiments of a sign assembly in accordance with the present disclosure.
Figure 12B:
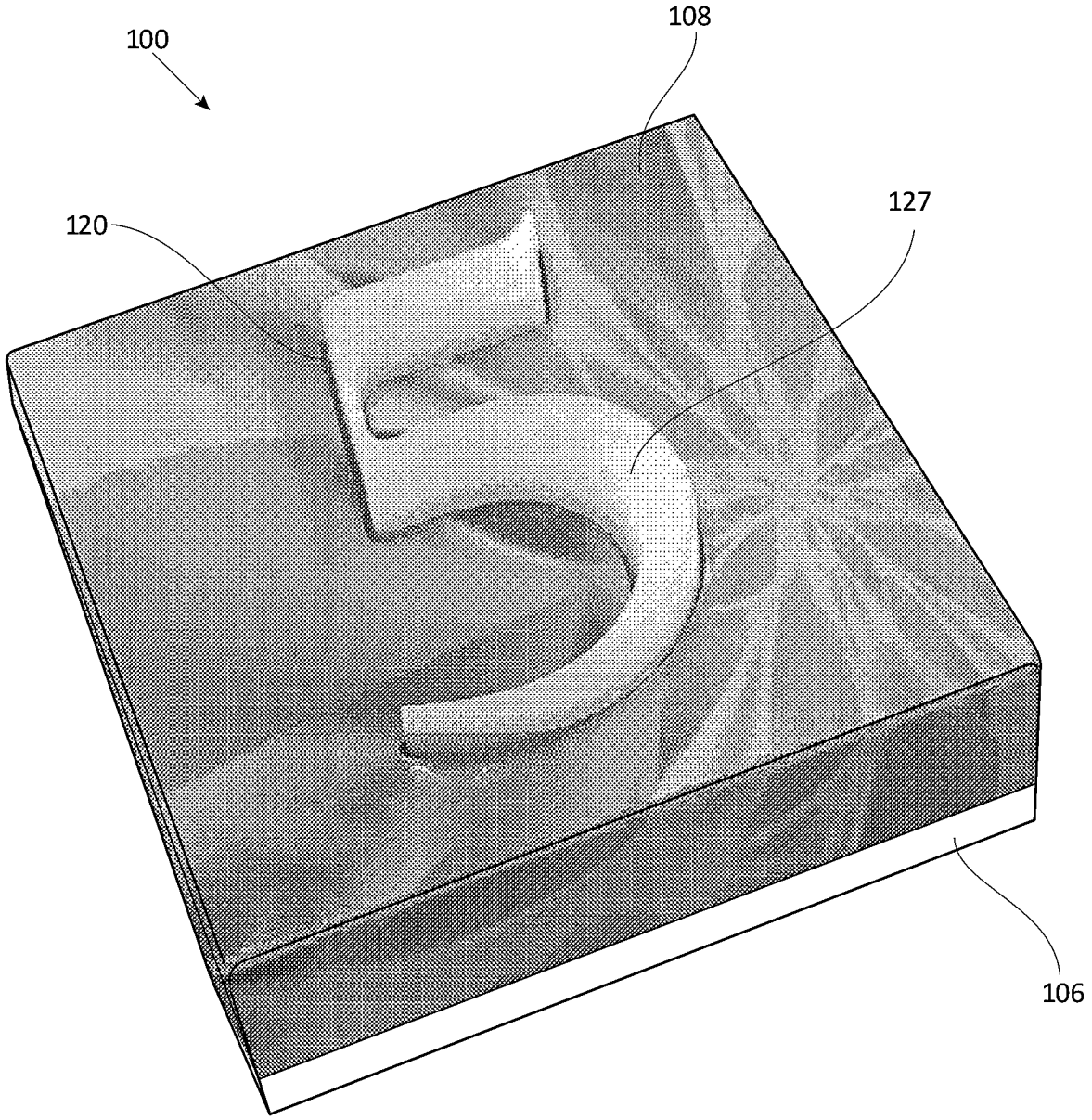
Figure 12C:
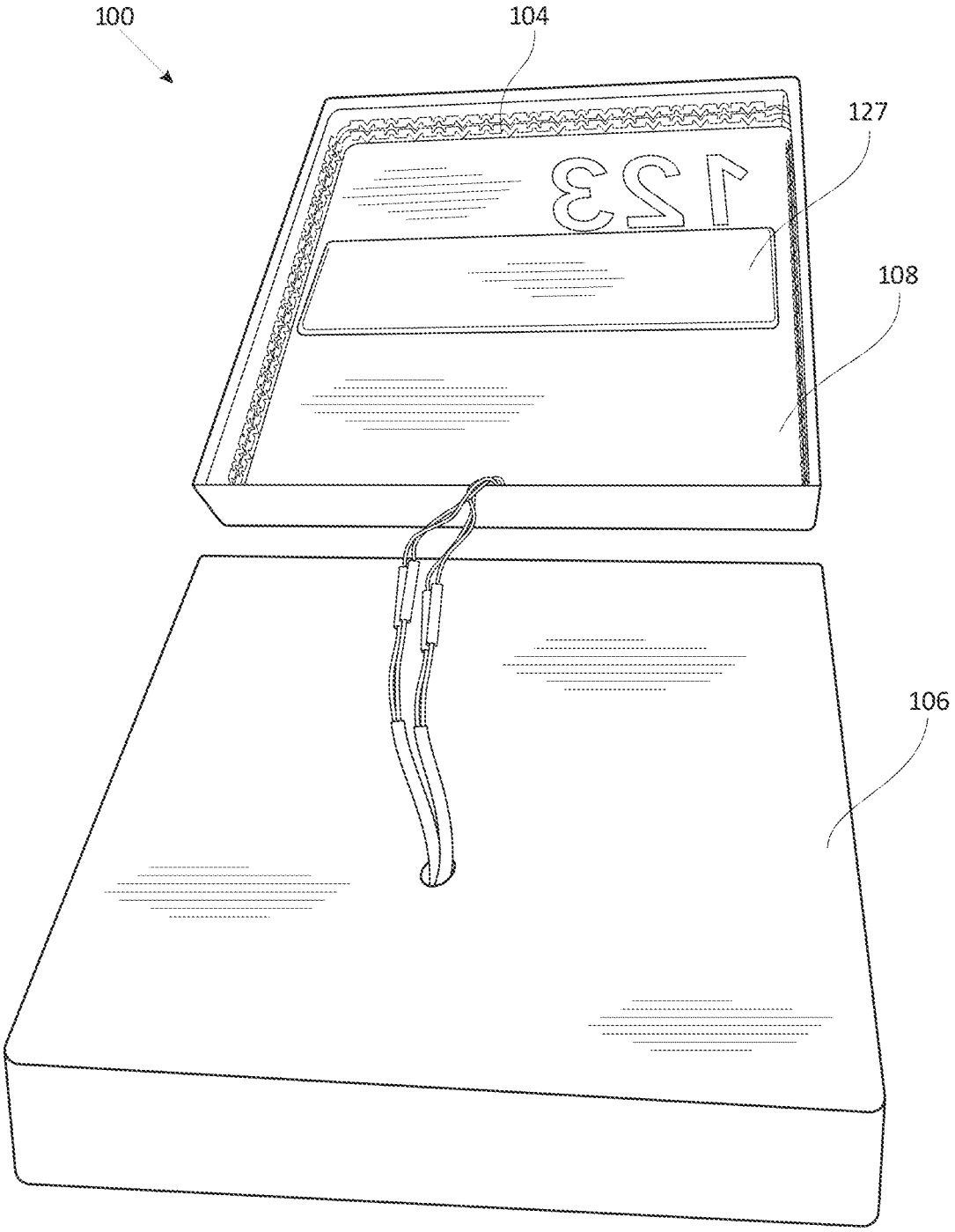
Figure 12D:
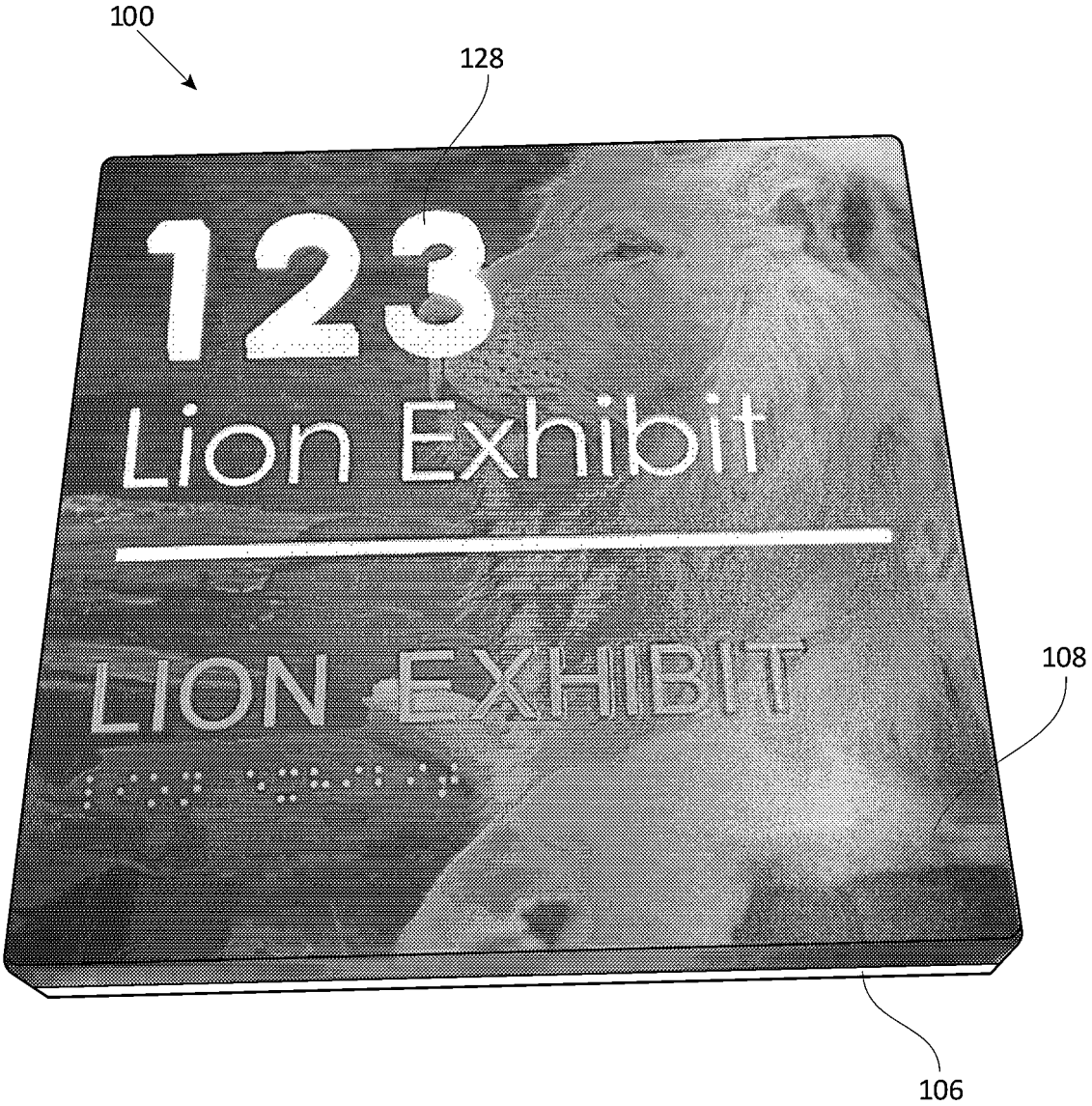

In some embodiments, the insert 127 can be designed as a raised portion of the illumination panel 106. In some embodiments, the insert 127 is coupled to the decorative panel 108 to protrude through the cutout 120, as shown in FIG. 12C. The insert 127 can provide a texture, such as a frosted, while enabling illumination from the light sources 104 to emit therethrough without additional costs of milling push through graphic, for example, depicted in FIG. 12B and FIG. 12D. Using a translucent insert 128 to fill in the cutouts can provide a combination of manufacturing simplification, cost reduction, etc. while providing extra space within the enclosure created by the illumination panel 106 and decorative panel for other elements (e.g., batteries). When the sign is illuminated, light from the light source(s) 104 can pass through translucent material (e.g., acrylic material). The illumination can emphasize the message, draws attraction to the sign and creates another dimension to how the message is communicated to the viewer.

In some embodiments, the combination of the translucent insert 127 through the front of the decorative panel 108 and the translucent back panel 126 making up a portion of the signage assembly sidewalls can provide multiple areas of the sign assembly 100 that can emit illumination from the lighting source 104.

In some embodiments, a unique process can be implemented to create the sign assemblies depicted in FIGS. 11A-12D. The process can include at least some of the following steps.

Initially, the decorative panel 108 is formed into a three-dimensional shape using a mechanical process. For example, the decorative panel 108 can be an aluminum panel that is "V" grooved using a dual head high speed automated router. If the panel 108 is designed to have graphics thereon, the panel 108 can be mechanically prepared for printing inks. For example, when inks do not readily bond with the printing surface of the decorative panel 108 (e.g., metal material), an adhesion promoter can be used to prepare the surface for a particular type of UV cured ink (or other ink type). In the instances of UV cured ink, the adhesion promoter must be applied with a lint free applicator in the direction of the grain in the metal and then the promoter should be allowed to dry and then be wiped off. Thereafter, a second coat can be applied and wiped off while still wet. Approximately 10 minutes can be allowed to pass and the decorative panel 108 can be wiped with an anti-static wand. This process improves the adherence of the ink markedly. This process, or a similar process, can also be used on acrylic, glass, some wood and ceramic tiles. Once prepared for inks, graphics can be printed on the panel 108, for example, using a special ultraviolet 12 color printer. In some instances, a protective coating can be layered over the graphics, for example, a special protective clear coat can be sprayed over the panel 108 to enhance the durability of the graphics while maximizing the contrast and vibrancy of the printing.

Similarly, if the panel 108 is designed to have cutouts 120, the panel 108 is then mechanically prepared for cutting out a portion thereof. For example, the panel 108 can be stencil cut using a Laser to create the cutout(s) 120 in the decorative panel 108. The rear panel 106 and/or the translucent insert 128 can be molded to fit the cutouts 120. For example, push thru acrylic graphics (on the translucent insert 128 and/or rear panel 106) can be step milled using a dual head high speed automated router. Once any cutouts 120 have been created and graphics have been printed on the decorative panel 108, the corners can be snapped out and the sides bent up to an approximately 90-degree angle creating a three-dimensions shape with a "wrap" of the graphics from face to the sides of the panel 108.

With the decorative panel 108 decorated and shaped, the enclosure of the sign assembly 100 can be assembled. The lighting sources 104 (e.g., LEDs) can be coupled into the interior of the three-dimensional share, for example, with structural adhesive. Similarly, the power source for the lighting sources 104 can be incorporated, for example, batteries and/or wiring can be incorporated within the panel 108. The illumination from the lighting sources 104 can be adjusted to a desired brightness, coloring, saturation, etc. The interior of the panel 108 can also include coupling the translucent insert 128 to the panel 108, for example using any combination of adhesion, mechanical fastener, welding, etc.

Once the interior of the panel 108 is completed, the backside of the panel 108 can be fit with a rear panel 106 to form the overall enclosure. For example, the aluminum decorative panel 108 can be coupled to a step milled acrylic lens that has been frosted on the sides to diffuse light. The sides and/or the backside of the push thru acrylic graphics (on the translucent insert 128 and/or rear panel 106) may have a colored translucent vinyl applied thereby creating a custom illuminated graphics color. When hard wired power is needed, the wiring harness can exit the assembled unit thru the rear panel 106 to be plugged into a power source. Although examples of materials, manufacturing methods, combination of design elements (e.g., graphics, raised/embedded lettering, etc.), etc. are provided herein, the present disclosure is not intended to be limited to any combination of examples provided herein and they are provided for example purpose only.

In operation, the sign assembly 100 can be utilized for any combination of signage. For example, the sign assembly 100 can be utilized for projecting double face wall mounted signage, ceiling hung double or single face signage, personnel signage for cubicles with changeable inserts, and directories or other wayfinding applications.

As utilized herein, the terms "comprises" and "comprising" are intended to be construed as being inclusive, not exclusive. As utilized herein, the terms "exemplary", "example", and "illustrative", are intended to mean "serving as an example, instance, or illustration" and should not be construed as indicating, or not indicating, a preferred or advantageous configuration relative to other configurations.

As utilized herein, the terms "about", "generally", and "approximately" are intended to cover variations that may existing in the upper and lower limits of the ranges of subjective or objective values, such as variations in properties, parameters, sizes, and dimensions. In one non-limiting example, the terms "about", "generally", and "approximately" mean at, or plus 10 percent or less, or minus 10 percent or less. In one non-limiting example, the terms "about", "generally", and "approximately" mean sufficiently close to be deemed by one of skill in the art in the relevant field to be included. As utilized herein, the term "substantially" refers to the complete or nearly complete extend or degree of an action, characteristic, property, state, structure, item, or result, as would be appreciated by one of skill in the art. For example, an object that is "substantially" circular would mean that the object is either completely a circle to mathematically determinable limits, or nearly a circle as would be recognized or understood by one of skill in the art. The exact allowable degree of deviation from absolute completeness may in some instances depend on the specific context. However, in general, the nearness of completion will be so as to have the same overall result as if absolute and total completion were achieved or obtained. The use of "substantially" is equally applicable when utilized in a negative connotation to refer to the complete or near complete lack of an action, characteristic, property, state, structure, item, or result, as would be appreciated by one of skill in the art.

Numerous modifications and alternative embodiments of the present disclosure will be apparent to those skilled in the art in view of the foregoing description. Accordingly, this description is to be construed as illustrative only and is for the purpose of teaching those skilled in the art the best mode for carrying out the present disclosure. Details of the structure may vary substantially without departing from the spirit of the present disclosure, and exclusive use of all modifications that come within the scope of the appended claims is reserved. Within this specification embodiments have been described in a way which enables a clear and concise specification to be written, but it is intended and will be appreciated that embodiments may be variously combined or separated without parting from the present disclosure. It is intended that the present disclosure be limited only to the extent required by the appended claims and the applicable rules of law. It is also to be understood that the following claims are to cover all generic and specific features of the present disclosure described herein.

What is claimed is:

1. A sign assembly comprising:

an illumination panel;

a decorative panel mounted to the illumination panel and comprising informational graphics; and one or more light sources positioned such that the illumination panel is illuminated by the one or more light sources to provide a light band about the decorative panel, wherein the decorative panel is three dimensional such that the decorative panel is coupled to the illumination panel to form an enclosure, and the one or more light sources are disposed in the enclosure.

2. The sign assembly of claim 1, wherein the illumination panel is made of a transparent material or a translucent material.

3. The sign assembly of claim 1, wherein the decorative panel includes at least one cutout comprising stencil-cut graphics so that the stencil-cut graphics are illuminated by the illumination panel.

4. The sign assembly of claim 3, wherein a light transmitting insert is disposed in the at least one cutout of the decorative panel.

5. The sign assembly of claim 1, wherein the decorative panel is a sheet of decorative material.

6. The sign assembly of claim 1, wherein the one or more light sources comprises a plurality of light emitting diodes (LEDs) positioned around an interior perimeter of the decorative panel.

7. The sign assembly of claim 1 further comprising a background panel mounted on the illumination panel opposite the decorative panel.

8. The sign assembly of claim 7, wherein the background panel includes a recessed area therein sized and shaped to receive at least a portion of the illumination panel.

9. The sign assembly of claim 8, wherein the background panel is a textured, colored acrylic.

10. The sign assembly of claim 8, wherein the illumination panel is mounted on the background panel in a location such that a portion of the illumination panel extends beyond a perimeter of the background panel.

11. A sign assembly comprising:

an illumination panel made of a translucent material and having a first side and a second side opposing the first side;

an opaque decorative panel mounted to the first side of the illumination panel and comprising informational graphics;

a background panel mounted to the second side of the illumination panel, the illumination panel being disposed within a recessed area in the background panel with at least an exposed portion of the illumination panel protruding from the recessed area; and one or more light sources positioned to illuminate the illumination panel such that light emanates from the exposed portion of the illumination panel to create a light band about the decorative panel.

12. The sign assembly of claim 11, wherein the background panel is a textured acrylic.

13. The sign assembly of claim 11, wherein the illumination panel is mounted on the background panel such that the illumination panel extends beyond a perimeter of the background panel.

14. The sign assembly of claim 11, wherein the decorative panel includes a cutout comprising stencil-cut graphics exposing at least a portion of the illumination panel so that the stencil-cut graphics are illuminated by the one or more light sources of the illumination panel.

15. The sign assembly of claim 14, wherein a light transmitting insert is disposed in the cutout of the decorative panel.

16. The sign assembly of claim 11, wherein the decorative panel is a sheet of decorative material.

17. The sign assembly of claim 11, wherein the decorative panel is three dimensional such that the decorative panel and the illumination panel form an enclosure, and the one or more light sources are disposed in the enclosure.

18. A sign assembly comprising:

an illumination panel made of a translucent material and having a first side and a second side opposing the first side:

an opaque decorative panel mounted to the first side of the illumination panel and comprising informational graphics:

a background panel mounted to the second side of the illumination panel such that the illumination panel extend beyond a perimeter of the background panel, the illumination panel being disposed within a recessed area in the background panel with at least an exposed portion of the illumination panel protruding from the recessed area: and one or more light sources positioned to illuminate the illumination panel such that light emanates from the exposed portion of the illumination panel to create a light band about the decorative panel.

19. The sign assembly of claim 18, wherein the background panel is a textured, colored acrylic.

20. A sign assembly comprising:

an illumination panel;

a decorative panel mounted to the illumination panel and comprising informational graphics;

one or more light sources positioned such that the illumination panel is illuminated by the one or more light sources to provide a light band about the decorative panel; and a background panel mounted on the illumination panel opposite the decorative panel, wherein the background panel includes a recessed area therein sized and shaped to receive at least a portion of the illumination panel.

21. The sign assembly of claim 20, wherein the background panel is a textured, colored acrylic.

22. The sign assembly of claim 20, wherein the illumination panel is mounted on the background panel in a location such that a portion of the illumination panel extends beyond a perimeter of the background panel.

* * * * *